US006773772B2

(12) United States Patent
Shinozaki et al.

(10) Patent No.: US 6,773,772 B2
(45) Date of Patent: Aug. 10, 2004

(54) THERMAL TRANSFER SHEET, THERMAL TRANSFER RECORDING METHOD, AND THERMAL TRANSFER RECORDING SYSTEM

(75) Inventors: Kensuke Shinozaki, Tokyo-to (JP); Kazunori Yokouchi, Tokyo-to (JP); Hideichiro Takeda, Tokyo-to (JP); Taketomo Katai, Tokyo-to (JP)

(73) Assignee: DAI Nippon Printing Co., Ltd., Tokyo-to (JP)

( * ) Notice: Subject to any disclaimer, the term of this patent is extended or adjusted under 35 U.S.C. 154(b) by 112 days.

(21) Appl. No.: 10/099,432

(22) Filed: Mar. 15, 2002

(65) Prior Publication Data

US 2002/0140799 A1 Oct. 3, 2002

Related U.S. Application Data

(62) Division of application No. 09/392,877, filed on Sep. 9, 1999, now Pat. No. 6,387,846.

(30) Foreign Application Priority Data

Sep. 10, 1998 (JP) ..... P10-256152
Sep. 11, 1998 (JP) ..... P10-258953
Sep. 17, 1998 (JP) ..... P10-263046

(51) Int. Cl.[7] ..... B41M 5/40
(52) U.S. Cl. ..... 428/32.6; 428/29
(58) Field of Search ..... 428/29, 32.6

(56) References Cited

U.S. PATENT DOCUMENTS 5,169,828 A * 12/1992 Janssens et al. ..... 503/227
5,630,869 A * 5/1997 Amon et al. ..... 106/31.37
5,853,255 A * 12/1998 Soshi et al. ..... 400/237
6,088,048 A * 7/2000 Soshi et al. ..... 347/188

* cited by examiner

*Primary Examiner*—B. Hamilton Hess
(74) *Attorney, Agent, or Firm*—Ladas & Parry

(57) ABSTRACT

A thermal transfer sheet is equipped with an approval information of being approved as applicable to the predetermined printer. When the thermal transfer sheet is set on a printer and a determinator determines that the approval information is correct for the printer, the printer is interlocked with the determinator to actuate in the state where the thermal transfer sheet is set thereon. A front part of a thermal transfer sheet may be provided with a mark coded from the approval information. The mark may be formed of a material detectable with the light in a visible region or invisible region, a magnetic material, an electrically conductive material, a material responsive to microwave or a resonance circuit. The approval information may be recorded on an approval card, a resonance circuit or IC card which makes a pair with a thermal transfer sheet. In addition, a host system as a determinator may be connected to a facsimile as a printer via a communication circuit.

9 Claims, 6 Drawing Sheets

THERMAL TRANSFER SHEET, THERMAL TRANSFER RECORDING METHOD, AND THERMAL TRANSFER RECORDING SYSTEM

This application is a division of U.S. Ser. No. 09/392,877 filed Sep. 9, 1999, now U.S. Pat. No. 6,387,846 which U.S. application is hereby incorporated herein by reference.

BACKGROUND OF THE INVENTION

1. Field of the Invention

The present invention relates to a thermal transfer sheet, a thermal transfer recording method, and a thermal transfer recording system and, more particularly, it relates to a thermal transfer sheet, a thermal transfer recording method, and a thermal transfer recording system, which can regulate so as to limit the use to authentic thermal transfer sheets which received the approval of the quality assurance by printer manufacturers so that appropriate printing can be performed in a printer, and which can prevent deterioration of the printing quality and deterioration of a thermal head.

The present invention also relates to a thermal transfer sheet, a thermal transfer recording method, and a thermal transfer recording system, which can regulate so as to limit the use to authentic thermal transfer sheet which received the approval of the quality assurance by printer manufacturers, and at the same time which can prevent deterioration of the printing quality and deterioration of a thermal head when a cassette case is reused by exchanging of a thermal transfer sheet.

The present invention further relates to a thermal transfer sheet, a thermal transfer recording method, and a thermal transfer recording system which can be used for facsimiles and, more particularly, it relates to a thermal transfer sheet, a thermal transfer recording method, and a thermal transfer recording system, which can regulate so as to limit the use to authentic thermal transfer sheets which received the approval of the quality assurance by facsimile apparatus manufacturers so that appropriate printing can be performed with facsimile apparatuses, and which can prevent deterioration of the printing quality and deterioration of a thermal head, in a method of recording, by thermal transfer, the reception contents on a recording paper using a thermal transfer sheet with facsimile apparatuses by which users can transmit to any receiver, or receive and record manuscripts via the communication circuit.

2. Description of the Related Art

There have been hitherto used thermal transfer sheets in which a thermally transferable layer of a heat meltable ink layer or a sublimation dye layer is provided on one side of a substrate film as a thermal transfer recording medium used for thermal printers, facsimiles and the like.

The previous thermal transfer sheets are the sheets on which a heat meltable ink layer or a sublimation dye ink layer is provided thereon by using as a substrate film a paper such as a condenser paper and a paraffin paper having the thickness of around 10 to 20 $\mu$m or a plastic film such as polyester and cellophane having the thickness of around 3 to 20 $\mu$m and coating on this substrate film a heat meltable ink obtained by mixing a wax with a colorant such as a pigment, a dye and the like or a sublimation dye ink obtained by dispersing or dissolving a sublimation dye in a resin binder.

And printing is performed by heating and pressing predetermined positions of the thermal transfer sheet with a thermal head from a back side of the substrate film to melt or sublimate an ink layer located corresponding to a printing part among a heat meltable ink layer or a sublimation dye layer and, which is thereby transferred to a printing paper.

In addition, there are generally used thermal transfer sheets in continuous lengths and in the form of rolled up sheets obtained by rolling up on a supply bobbin and adhering a front end of rolled up thermal transfer sheet to a rolling up bobbin. And thermal transfer sheets are contained in a thermal transfer sheet cassette in many cases and thermal transfer sheets are exchanged as a thermal transfer sheet cassette containing a thermal transfer sheet at the end of using the thermal transfer sheet and recently, however, users simply exchange thermal transfer sheets and cassettes are reused from a viewpoint of the reuse of resources and the like.

In addition, thermal transfer recording media are generally used by rolling up a thermal transfer sheet on a supply bobbin, connecting a lead film to a front end of the rolled up thermal transfer sheet, and adhering a front end of the lead film to the rolling up bobbin, which is mounted on a printer. The lead film exerts respective functions such as guidance and pulling up of a thermal transfer sheet at an initial stage of use, protection of a rolled unused thermal transfer sheet from the outside, improvement of the workability and accuracy of mounting when a thermal transfer sheet is mounted on a cassette or directly on a printer, and removal of crease upon rolling up of a thermal transfer sheet after starting of use (See JP-A(Kokai)-6-336065, JP-A(Kokai)-9-272247).

In addition, there is disclosed a cassette for a thermal transfer sheet in which a display label of the number of sheets on which information regarding the number of recordable image planes of the thermal transfer sheet is recorded is applied to a front end of the thermal transfer sheet without connecting a lead film to the thermal transfer sheet (JP-U(Kokai)-63-68452).

Furthermore, there is disclosed such a thermal transfer sheet cassette that it is not misused in a printer, a light diffraction structure on which information for printing is recorded as a light diffraction image is provided in order to prevent forgery, the surface of the light diffraction structure is formed to be on the same level of that of the cassette case or on the more recessed level than that of the case surface, and the light diffraction structure having the fragility is used (JP-A(Kokai)-8-318657, JP-A(Kokai)-8-318658).

There are many kinds of thermal transfer printers and required to have the excellent printing quality such as the clearness of a printed image, high concentration, high sensitivity and the like. To the contrary, an amount of a thermal transfer sheet to be used in a printer has been increasing and many products which have not received approval of the quality assurance by printer manufacturers, that is, a thermal transfer sheet which is not authentic called as a pirated article are on the market.

When this pirated article is used in a printer, it is inferior in the matching properties with that printer, and deterioration of the printing quality and deterioration of a thermal head occur frequently, leading to problems.

However, in the thermal transfer sheet with the lead film as described above, the misuse can be prevented and operations can be easier upon mounting on a printer but it can not be regulated that the use of it in a printer is limited to thermal transfer sheets which received approval of the quality assurance by printer manufacturers, that is, authentic thermal transfer sheets so that appropriate printing can be performed to that printer.

In addition, when the aforementioned display label of the number of sheets on which information regarding the number of recordable image planes is recorded is applied to a front end of a thermal transfer sheet, a printer can be endowed with information regarding the number of recordable image planes but it can not be regulated that the use of it in that printer is limited to authentic thermal transfer sheets.

In addition, the provision of a light diffraction structure on which information for printing is recorded as a light diffraction image in the aforementioned cassette case is assumed that exchange is made as a cassette when the use of a thermal transfer is completed and the thermal transfer sheet is exchanged with a new one and, therefore, if a cassette is opened and a thermal transfer sheet contained therein is exchanged with not authentic one for use, it can not be regulated so that the use is limited to authentic thermal transfer sheets.

SUMMARY OF THE INVENTION

Therefore, the first object of the present invention is to solve the aforementioned problems and provide a thermal transfer sheet, a thermal transfer recording method, and a thermal transfer recording system, which can regulate so as to limit the use to the authentic thermal transfer sheets which received the approval of the quality assurance by printer manufacturers or the like so that appropriate printing can be performed in a printer, and which can prevent deterioration of the printing quality and deterioration of a thermal head.

The second object of the present invention is to provide a thermal transfer sheet, a thermal transfer recording method, and a thermal transfer recording system, which can regulate so as to limit the use to thermal transfer sheet which received the approval of the quality assurance by printer manufacturers, that is, authentic thermal transfer sheets so that appropriate printing can be performed in a printer, and at the same time which can prevent deterioration of the printing quality and deterioration of a thermal head when a cassette case is reused and a thermal transfer sheet is contained in a cassette case for exchange.

The third object of the present invention is to provide a thermal transfer sheet, a thermal transfer recording method, and a thermal transfer recording system, which can regulate so as to limit the use to thermal transfer sheets which received the approval of the quality assurance by printer manufacturers, that is, authentic thermal transfer sheets so that appropriate printing can be performed in a printer built in a facsimile apparatus, and which can prevent deterioration of the printing quality and deterioration of a thermal head.

In principle, the thermal transfer sheet relating to the present invention is characterized in that it is provided with an approved information that it is approved as applicable to the predetermined printer.

In addition, in principle, the thermal transfer recording method relating to the present invention is characterized in that a thermal transfer sheet provided with an approved information that it is approved as applicable to the predetermined printer is set on a printer, the aforementioned approved information is confirmed from a determinator and when the determinator determines that the aforementioned approved information is correct for the printer, the printer is interlocked with the determinator so as to actuate in the state where the thermal transfer sheet is set on the printer.

Furthermore, the thermal transfer recording system relating to the present invention comprises a printer and a determinator and is characterized in that, an approved information that it is approved as applicable to the predetermined printer which is in advance given to a thermal transfer sheet is confirmed from the determinator, and when the determinator determines that the approved information is correct for the printer, the printer is interlocked with the determinator to actuate in the state where the thermal transfer sheet is set on the printer.

In the first aspect of the present invention, a front end portion of the thermal transfer sheet is provided with a mark which is coded from an approved information that is approved as applicable to the predetermined printer.

In addition, in a thermal transfer recording method of the first aspect of the present invention, there is used a thermal transfer sheet in which its front end portion is provided with a mark which is coded from an approved information that is approved as applicable to the predetermined printer. And the thermal transfer sheet is set on a printer and a determinator is made to detect the mark coded from the approved information and, when the determinator determines that the approved information is correct for the printer, the printer is interlocked with the determinator to actuate in the state where the thermal transfer sheet is set on the printer.

In addition, in the first aspect of the present invention, a thermal transfer recording system comprises a printer and a determinator and is characterized in that, a mark which is coded from approved information that it is approved as applicable to the predetermined printer, which has been provided on a front end portion of a thermal transfer sheet, is confirmed from the determinator, in response to the confirmation, the determinator detects the mark, and when the determinator determines that the approved information is correct for the printer, the printer is interlocked with the determinator to actuate in the state where the thermal transfer sheet is set on the printer.

In addition, it is preferred that the mark is formed on a thermal transfer sheet.

In addition, it is preferred that the mark is formed on a lead film adhered to a front end of a thermal transfer sheet.

Though the mark can be a visible mark detectable with the visible light or an invisible mark not detectable with the visible light, it is preferable to make the mark as the invisible mark.

The invisible mark may detectable by absorbing or emitting in responsive to ultraviolet ray or infrared ray.

The invisible mark may be detectable by changing electromagnetic properties in response to a microwave.

The invisible mark may be a mark containing a magnetic material.

Alternatively, the invisible mark may be a mark containing an electrically-conductive material.

In another preferable embodiment, the mark is a resonance circuit which makes a resonance with the received high frequency wave to transmit an echo wave corresponding to the approval information.

In the first aspect, since a thermally transferable layer is provided on a substrate film of a thermal transfer sheet and a front end portion of the thermal transfer sheet is provided with a mark for identifying that the thermal transfer sheet is authentic, recording is initiated by reading with a thermal transfer printer corresponding to the thermal transfer sheet that the thermal transfer sheet is authentic. Therefore, it can be regulated that the use of a thermal transfer sheet in a printer is limited to thermal transfer sheets which received the quality assurance by printer manufacturers or the like, that is, authentic thermal transfer sheets and, when a cassette case is reused and a thermal transfer sheet is contained in a cassette case for exchange, deterioration of the printing quality and deterioration of a thermal head be prevented and appropriate printing can be performed for a printer. Thus, the first and second objects can be accomplished.

The second aspect of the present invention is characterized in that an approval card is combined with a thermal transfer sheet to be a pair, and the number of usable image planes and an invisible mark which is coded from approved information that is approved as applicable to the predetermined printer are recorded on the approval card.

In addition, in the second aspect of a thermal transfer recording method of the present invention, a thermal transfer sheet and an approval card are used as a pair. The number of usable image planes of the corresponding thermal transfer sheet and an invisible mark which is coded from approved information that the thermal transfer sheet is approved as applicable to the predetermined printer are recorded on the approval card. And the thermal transfer sheet is set on a printer, and the approval card is mounted on a card reader as a determinator and the reader is made to detect the invisible mark and, when the card reader determines that the invisible mark is correct for the printer, the printer is interlocked with the card reader to actuate in the state where the thermal transfer sheet is set on the printer.

In addition, in the second aspect of the invention, a thermal transfer recording system comprises a printer and a card reader as a determinator. On the other hand, an approval card is combined with a thermal transfer sheet to be used in this thermal transfer recording system as a pair and the number of usable image planes and an invisible mark which is coded from approved information that the thermal transfer sheet is approved as applicable to the predetermined printer are recorded on the approval card.

And, this thermal transfer system is characterized in that the card reader detects an invisible mark which is recorded on an approval card combined with a thermal transfer sheet as a pair and when the card reader determines that the invisible mark is correct for the printer, the printer is interlocked with the card reader to actuate in the state where the thermal transfer sheet is set on the printer.

It is preferred that the invisible mark is detectable by absorbance and emission in response to ultraviolet ray or infrared ray.

It is also preferred that the invisible mark is detectable by changing electromagnetic properties in response to a microwave.

The second embodiment of the second aspect of the present invention is characterized in that a resonance circuit is combined with the thermal transfer sheet as a pair, and, the resonance circuit makes a resonance with the received high frequency wave to transmit an echo wave corresponding to the number of usable image planes and the approval information.

In addition, in a thermal transfer recording method of the second embodiment of the second aspect, a thermal transfer sheet and a resonance circuit are used as a pair. An echo wave generated when the resonance circuit makes a resonance with the received high frequency wave is defined as a code showing the number of usable image planes of the corresponding thermal transfer sheet and an approval information that the thermal transfer sheet is approved as applicable to the predetermined printer. And the thermal transfer sheet is set on a printer, the resonance circuit is mounted on a reader as a determinator, an electromagnetic wave having the predetermined frequency is transmitted to the resonance circuit, and the reader is made to detect an echo wave generated from the resonance circuit in response to the electromagnetic wave. Then, when the reader determines that the echo wave is correct for the printer, the printer is interlocked with the reader to actuate in the state where the thermal transfer sheet is set on the printer.

In addition, in the second embodiment of the second aspect of the present invention, a thermal transfer recording system comprises a printer and a reader as a determinator. On the other hand, a resonance circuit is combined with a thermal transfer sheet to be used in this thermal transfer recording system as a pair, and an echo wave generated when the resonance circuit makes a resonance with the received high frequency wave is defined as a code showing the number of usable image planes of the corresponding thermal transfer sheet and an approval information that the thermal transfer sheet is approved as applicable to the predetermined printer.

And, this thermal transfer recording system is characterized in that the reader detects an echo wave generated from the resonance circuit in response to a transmitted electromagnetic wave having the predetermined frequency, and when the reader determines that the detected echo wave is correct for the printer, the printer is interlocked with the reader to actuate in the state where the thermal transfer sheet is set on the printer.

The third embodiment of the second aspect of the present invention is characterized in that an IC card having an integrated circuit is combined with a thermal transfer sheet as a pair, and the number of usable image planes of the corresponding thermal transfer sheet is previously and electrically recorded on the integrated circuit and at the same time a code showing approved information that the thermal transfer sheet is approved as applicable to the predetermined printer is recorded on the integrated circuit.

In addition, in a thermal transfer recording method of the third embodiment of the second aspect, a thermal transfer sheet and an IC card are used as a pair. The number of usable image planes of the corresponding thermal transfer sheet is previously and electrically recorded and at the same time a code showing approved information that the thermal transfer sheet is approved as applicable to the predetermined printer is recorded on the integrated circuit. And the thermal transfer sheet is set on a printer and the IC card is mounted on a card reader as a determinator, the predetermined signal is sent to the IC card and the card reader is made to detect a signal of approval information produced from the integrated circuit of the IC card in response to the sent signal. And, when the card reader determines that the signal is correct for the printer, the printer is interlocked with the card reader to actuate in the state where the thermal transfer sheet is set on the printer.

In addition, in the third embodiment of the second aspect of the present invention, a thermal transfer recording system comprises a printer and a card reader as a determinator. On the other hand, an IC card is combined with a thermal transfer sheet to be used in this thermal transfer recording system as a pair, and the number of usable image planes of the corresponding thermal transfer sheets is electrically recorded in advance on an integrated circuit of the IC card and at the same time a code showing approval information that the thermal transfer sheet is approved as applicable to the predetermined printer is recorded on the integrated circuit.

And, this thermal transfer recording system is characterized in that the card reader detects a signal produced from the integrated circuit of the IC card in response to the predetermined signal which was sent to the IC card combined with a thermal transfer sheet as a pair and when the card reader determines that the detected signal is correct for the printer, the printer is interlocked with the card reader to actuate in the state where the thermal transfer sheet is set on the printer.

The integrated circuit may make the number of the remaining usable image planes recordable by subtracting the actually used number of image planes from the original number of usable image planes every time when thermal transfer is performed. In the use of such a IC card, the number of the remaining usable image planes can be additionally recorded on the integrated circuit by subtracting the actually used number of image planes from the original number of usable image planes every time thermal transfer performed. In addition, when the card reader detects a signal produced from the integrated circuit of the IC card and determines that the approval information is correct for a printer and the actually used number of the image planes dose not exceed the original number of the usable image planes, it makes possible to actuate the printer.

In the invention of the second aspect, since a thermal transfer sheet and any one of an approval card, a resonance circuit and an IC card are combined at one versus one, the regularity of the approval card, the resonance circuit or the IC card means that the thermal transfer sheet is regular and authentic. Therefore, it can be regulated such that the use of the thermal transfer sheet is limited to thermal transfer sheets which received approval of the quality assurance by printer manufacturers or the like and, further, deterioration of the printing quality and deterioration of a thermal head can be prevented. That is, the first object of the present invention can be accomplished.

The third aspect of the present invention is characterized in that an approval code showing that a thermal transfer sheet is approved as applicable to the predetermined printer is given to the thermal transfer sheet and the approval code is registered at a host system capable of being accessed via a communication circuit.

In addition, a thermal transfer recording method of the third aspect of the present invention relates to a method capable of thermally transfer recording the reception contents on a recording paper by using a thermal transfer sheet with a facsimile apparatus by which users can transmit manuscripts to any place or receive it via a communication circuit. In this method, a thermal transfer sheet to which an approval code that a thermal transfer sheet was approved as applicable to the predetermined printer is given is set on a facsimile apparatus as a printer, and the facsimile apparatus is connected to a host system as a determinator via a communication circuit, the approval code is input in the host system via a communication circuit to be confirmed and, when the host system determines that the approval code is correct for the printer, the facsimile apparatus is interlocked with the host system to bring into the receivable and recordable state.

In addition, thermal transfer recording system of the third aspect is characterized in that a facsimile as a printer and a host system as a determinator are connected via a communication circuit, and an approval code that a thermal transfer sheet is approved as applicable to the predetermined printer, which was given in advance to the thermal transfer sheet, is input in the host system via a communication circuit and confirmed therefrom and, when the host system determines that the approval code is correct for the facsimile apparatus, the facsimile apparatus is interlocked with the host system to become receivable in the state the thermal transfer sheet is set on the facsimile apparatus.

As the approval code, an approval number can be used.

In addition, it is preferred that determination is conducted by registering in advance the regular approval code at the host system and checking the approval code input in the host system with a list of approval codes registered in advance in the host system.

In addition, it is preferred that the correct approval code once input in the host system is not reused.

In the third aspect of the present invention, in the case where the users want to record the reception contents on a recording paper via a communication circuit using a thermal transfer sheet, the facsimile apparatus is connected to a host system of the manufacturer or the like of the facsimile apparatus via a communication system, and the users input in the host system an approval code given to a thermal transfer sheet to be used, and the host system checks whether the approval code has been registered or not, and only when it is determined that the approval code is correct, the facsimile apparatus becomes receivable and recordable.

Therefore, it can be regulated such that the use of a thermal transfer sheet is limited to thermal transfer sheets having the correct approval code, that is, thermal transfer sheets which received approval of the quality assurance by facsimile apparatus manufacturers or the like called as authentic thermal transfer sheets, and deterioration of the printing quality and deterioration of a thermal head can be prevented. Thus, the third object of the present invention can be accomplished.

DETAILED DESCRIPTION OF THE PREFERRED EMBODIMENTS

The embodiments of the present invention will be described in detail below.

First, the first aspect of the present invention will be explained.

Figure 1:
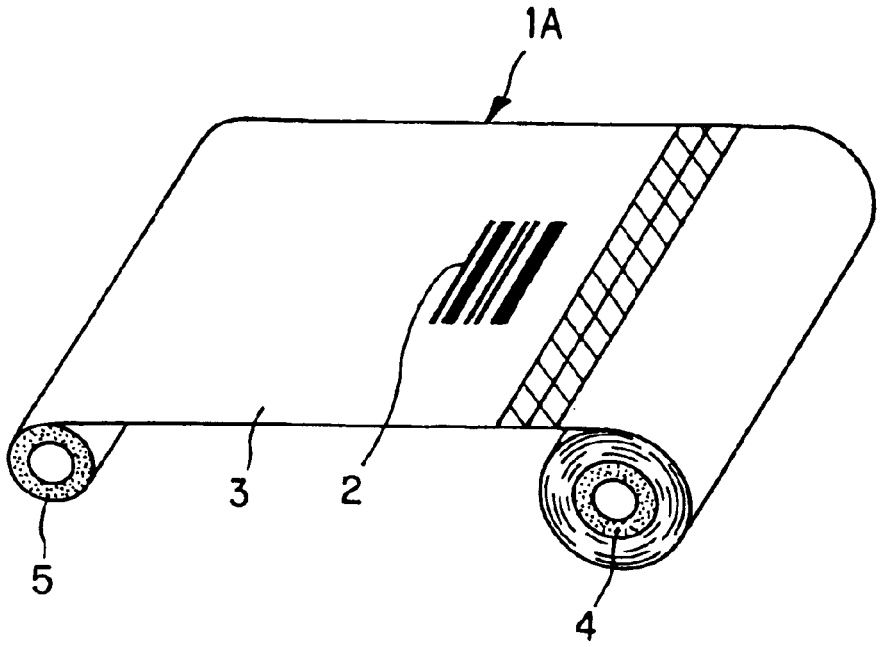
FIG. 1 is a perspective view showing one embodiment of a thermal transfer sheet of the first aspect in accordance with the present invention.
Figure 2:
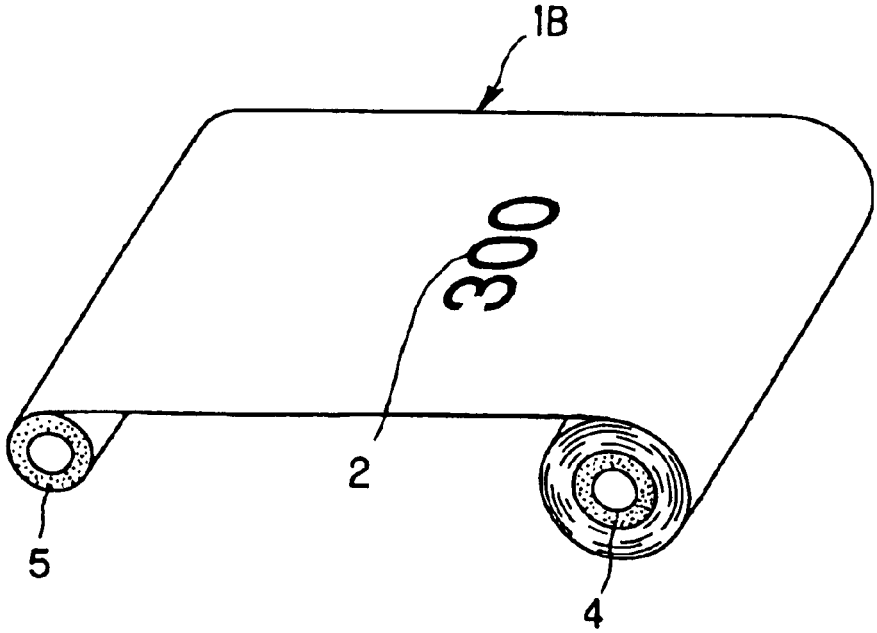
FIG. 2 is a perspective view showing an another embodiment of a thermal transfer sheet of the first aspect in accordance with the present invention.
Figure 3:
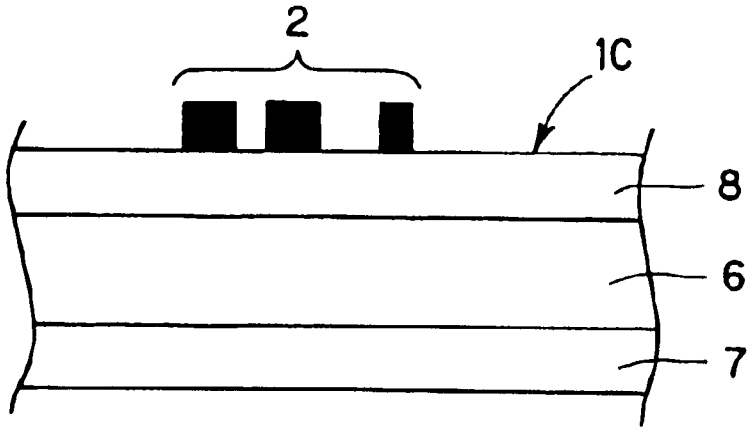
FIG. 3 is a cross-sectional view showing one embodiment of a thermal transfer sheet of the first aspect in accordance with the present invention.

As an embodiment of a thermal transfer sheet belonging to the first aspect, there can be mentioned of thermal transfer sheets 1 (1A–1C) shown in FIGS. 1 to 3. As shown in FIG. 1, in a thermal transfer sheet 1A, a lead film 3 is connected to an end of the final rolling of a thermal transfer sheet 1 which is rolled up on a supply bobbin 4, an end of the lead film 3 is adhered to a rolling up bobbin 5, and a pattern-like mark (a mark having the predetermined pattern) 2 identifying that the thermal transfer sheet 1A is authentic is formed on the lead film 3.

In addition, in a thermal transfer sheet 1B of the first aspect, an end of the final rolling of the thermal transfer sheet which is rolled up on a supply bobbin 4 is directly adhered to a rolling up bobbin 5 and a pattern-like mark 2 is formed on the thermal transfer sheet at its front end as shown in FIG 2.

In addition, in a thermal transfer sheet 1C of the first aspect, one side of a substrate film 6 may be provided with thermally transferable layer 7, and the other side of the substrate film 6 may be provided with a rear layer 8 in order to improve the heat resistance and the slipping ability in contact with a thermal head upon printing, and a pattern-like mark 2 identifying that a thermal transfer sheet 1 is authentic may be provided on the rear layer 8 as shown in FIG. 3.

(Substrate Film)

As the substrate film 6 used in the thermal transfer sheet of the first aspect, the same substrate sheets as those used in the previous thermal transfer sheets may be used and other substrate films may be used, being not limiting.

Examples of the preferable substrate films include: plastics such as polyester, polypropylene, cellophane, polycarbonate, cellulose acetate, polyethylene, polyvinyl chloride, polystyrene, nylon, polyimide, polyvinylidene chloride, polyvinyl alcohol, fluorine resin, chlorinated rubber, ionomer and the like; papers such as condenser paper, paraffin paper and the like; nonwoven cloth and the like; and substrate films obtained by compounding these films.

Although the thickness of the substrate film may be appropriately varied depending upon materials so that the strength and the thermal conductivity become suitable, the thickness is preferably, for example, 2 to 25 $\mu$m.

(Rear Layer)

In addition, a rear layer 8 may be provided on the other side of the substrate film in order to prevent the adhesion of a thermal head and improve the slipping ability.

This rear layer is formed by appropriately using and mixing a surfactant, an inorganic particle, an organic particle, a pigment and the like with a binder resin.

As the binder resin used in the rear layer, there are, for example, cellulose resins such as ethyl cellulose, hydroxyethyl cellulose, hydroxypropyl cellulose, methyl cellulose, cellulose acetate, cellulose acetate butyrate and cellulose nitrate; vinyl resins such as polyvinyl alcohol, polyvinyl acetate, polyvinyl butyral, polyvinyl acetal, polyvinyl pyrrolidone, acrylic resin, polyacrylamide and acrylonitrile-styrene copolymer; polyester resin; polyurethane resin; silicone-modified or fluorine-modified urethane resin and the like.

It is preferred that, among them, the binder resins having a few reactive groups, for example, hydroxy group are used and polyisocyanate as a cross-linking agent is used together and, the thus obtained cross-linked resins are used.

In order to form a rear layer, a slipping agent, a surfactant, an inorganic particle, an organic particle, a pigment and the like are added to the binder resin, which is dissolved or dispersed in an appropriate solvent to prepare a coating solution, which is coated on the substrate by the conventional coating means such as a gravure coater, a roll coater and a wire bar, followed by drying.

(Thermally Transferable Layer)

The thermal transfer sheet of the first aspect comprises a thermally transferable layer 7 provided on one side of substrate film and the thermally transferable layers are classified into two kinds of a heat meltable ink layer and a sublimation dye layer.

First, as the heat meltable ink layer, there may be used heat meltable ink layers which comprises a colorant and a binder which have been previously known and in which, if necessary, various additives such as a mineral oil, a vegetable oil, higher fatty acid such as stearic acid and the like, a plasticizer, a thermoplastic resin, a filler and the like are added thereto.

As a wax component used as a binder, there are, for example, microcrystalline wax, carnauba wax, paraffin wax and the like. Furthermore, various waxes such as Fischer-Tropsch wax, various low-molecular polyethylene, Japan wax, bees wax, spermaceti, insect wax, wool wax, shellac wax, candelilla wax, petrolatum, polyester wax, partially modified wax, fatty acid ester, fatty acid amide and the like are used. Among these, in particular, waxes having a melting point of 50 to 85° C. are preferable. When a melting point is below 50° C., there may arise a problem on storage, while when a melting point is above 85° C., the sensitivity may become insufficient.

As a resin component used as a binder, there are, for example, ethylene-vinyl acetate copolymer, ethylene-acrylic acid ester copolymer, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, fluorine resin, polyvinyl formal, polyvinyl butyral, acetyl cellulose, nitrocellulose, polyvinyl acetate, polyisobutylene, ethyl cellulose, polyacetal and the like. In particular, the resin components which have been used as a heat-sensitive adhesive and have a relatively low softening point, for example, a softening point of 50 to 80° C. are preferable.

A colorant can be appropriately selected among the known organic or inorganic pigments and dyes. For example, colorants having the sufficient coloring density and which do not undergo color change and color deterioration by light, heat and the like are preferable. Alternatively, substances which develop color by heating, and substances which develop color by contacting with components coated on the surface of a transfer-receiving material may be used. The color of the colorants are cyan, magenta, yellow and black and are not limited to them. The colorants having various colors can be used.

Furthermore, in order to give the better heat conducting properties and heat meltable properties to the heat meltable ink layer, a heat conductive substance as a filler for the binder may be incorporated therein. Examples of such the filler are carbonous substances such as carbon black and the like, and metals and metal compounds such as aluminum, copper, tin oxide, molybdenum disulfide and the like.

The heat meltable ink layer may be formed by blending the above coloring component and the binder component as well as, as needed, a solvent component such as water, organic solvent and the like to prepare a coating solution for forming a heat meltable ink layer, which is coated by the previously known method such as hot melt coating, hot lacquer coating, gravure coating, gravure reverse coating, roll coating or the like. Alternatively, the heal meltable ink layer may be formed by using an aqueous or non-aqueous emulsion coating solution.

The thickness of the heat meltable ink layer should be decided such that the necessary printing density and heat sensitivity are harmonized. The thickness is usually in a range of 0.1 $\mu$m to 30 $\mu$m in the dried state, preferably around 1 $\mu$m to 20 $\mu$m.

Next, the sublimation dye layer is a layer in which a sublimation dye is carried in the binder resin. Any dyes which have been previously known and used for thermal transfer sheets can be effectively used in the present invention, being not limitative. For example, as some preferable dyes, there are MS Red G, Macrolex Red Vioret R, Ceres Red 7B, Samaron Red HBSL, Resolin Red F3BS and the like as a red dye, and Phorone Brilliant Yellow 6GL, PTY-52, Macrolex Yellow 6GL and the like as a yellow dye, Kayaset Blue 714, Wacsolin Blue AP-FW, Phorone Brilliant Blue S-R, MS Blue 100 and the like as a blue dye.

As the binder resin for carrying the sublimation dyes as described above, the previously known binder resins can be all used. Examples of the preferable binder resins are: cellulose resins such as ethyl cellulose, hydroxyethyl cellulose, ethylhydroxy cellulose, hydroxypropyl cellulose, methyl cellulose, cellulose acetate, cellulose acetate butyrate and the like; vinyl resins such as polyvinyl alcohol, polyvinyl acetate, polyvinyl butyral, polyvinyl acetal, polyvinyl pyrrolidone, polyacrylamide and the like; and, polyester and the like.

Alternatively, the sublimation dye layer may contain various previously known additives in addition to the aforementioned dyes and binder resins as necessary.

And the sublimation dye layer is formed by adding the aforementioned dye and binder resin and additives in an appropriate solvent to dissolve or disperse respective components, to prepare an ink which is coated on the aforementioned substrate film with the same previously known coating methods as those described for the heat meltable ink layer to form a sublimation dye ink layer.

The thickness of the sublimation dye layer is usually 0.1 to 5.0 $\mu$m in the dried state, preferably around 0.4 to 2.0 $\mu$m.

(Mark)

The thermal transfer sheet of the first aspect is provided with a mark 2 identifying that the thermal transfer sheet is authentic, at its front end or on the all side.

The mark 2 may be formed in the predetermined pattern with the use of a material having the particular optical properties in a visible light region, an ultraviolet region or an infrared region. Alternatively, the mark 2 having the magnetic properties, having the electrical-conductivity, or having the electromagnetic properties in responsive to microwave can be used.

The mark can be printed on the thermal transfer sheet or the lead film with an ink using carbon black having an absorption band at a visible light region or an ink having an absorption band at a red/infrared wavelength region such as an ink of cyan green. As a light source for optically reading this mark, a semiconductor laser or a light emitting diode having the emission wavelength around 650 nm, 800 nm or 950 nm is mainly used.

Next, the pattern-like mark having the particular optical properties in an ultraviolet region or an infrared region absorbs the light at those wavelength regions or emits the fluorescent light. This pattern-like mark can not be read in a visible light region and contains the invisible information, which makes it difficult to manufacture not authentic thermal transfer sheets, so-called pirated thermal transfer sheets and, thus, being preferable.

It goes without saying that "absorption" herein is required not to have the same absorption properties as those of a portion of the thermal transfer sheet or the lead film where the pattern-like mark is not provided, at these wavelength regions. If it is the same, since the pattern mark formed on the thermal transfer sheet or the lead film has no difference in properties relative to the light at these wavelength regions, the mark becomes unperceivable. In addition, the wavelength region having the particular optical properties may be the wavelength region of only ultraviolet ray, of only infrared ray, or of both ultraviolet ray and infrared ray.

In addition, when the pattern-like mark is formed on the transparent thermal transfer sheet or lead film as an invisible information, the pattern-like mark may be perceived not with an amount of the reflected light but with that of the transmitted light at the particular wavelength. In such the case, an amount of the transmitted light is decreased by shield depending upon the absorbing properties and the pattern-like mark can be perceived with the decreased amount of the transmitted light.

Examples of the material which forms the pattern-like mark of the thermal transfer sheet of the first aspect are not limited to but include the materials having the particular optical properties in an ultraviolet ray region or an infrared ray region. More particularly, for example, an ultraviolet absorber of an organic compound or an inorganic compound can be used as a transparent perceiving substance. When such the ultraviolet absorber is used, the ultraviolet absorber absorbing the light in ultraviolet ray region of not greater than 380 nm is good as long as it is not the same color as that of a portion adjacent to the pattern-like mark. When the material has the absorbing properties in a wavelength region of not less than 380 nm, the material tends to be colored in a visible light region, which makes possible the determination with naked eyes. Alternatively, the material may be a fluorescent substance emitting the fluorescent light.

As the ultraviolet absorber used as a perceiving substance, examples of the specific substance in the case of the organic compound are benzophenones, benzotriazoles, oxalic acid anilides, cyanoacrylates, salicylates and the like. Alternatively, when the inorganic compound is used, examples thereof are finely-divided powders of oxide of metal, transition metal and alkaline earth metal such as zinc oxide, iron oxide, magnesium oxide, titanium oxide, tin oxide, cerium oxide and the like. By using the finely-divided powders having the particle size of not greater than 0.2 $\mu$m, preferably not greater than 0.1 $\mu$m, particularly preferably 0.05 $\mu$m, the transparency can be obtained in a visible light region. When the particle size approaches a visible region above 0.2 $\mu$m, the color characteristic of respective finely-divided powders is developed in some cases, but even such the perceiving substance can be preferably used when it has the color close to that of a portion adjacent to the pattern-like mark. In such the case, the particle size may be not greater than 5 $\mu$m. In addition, the ultraviolet absorber of the inorganic compound is superior over the ultraviolet absorber of the organic compound in a respect of the long-term stability and the like.

Alternatively, as the perceiving substance which absorbs an infrared light, the finely-divided powders of phosphate salt glass containing trivalent ytterbium ($Yb^{3+}$) at an amount of 5 to 60% by weight can be used. Alternatively, even the organic dye may be used as the dye having the absorption in an infrared region, for example, cyanine dye, phthalocyanine dye, naphthoquinone dye, anthoraquinone dye, diol dye, triphenylmethane dye and the like. However, since these dyes have the absorption band at the wavelength region of not less than 600 nm, they display cyan color, or since they have around 30 to 40% absorption in a visible region (380–700 nm), they display slightly reddish cream color. For this reason, the completely colorless transparent information can not be obtained but, when it is the same color series as that of a portion adjacent to the pattern-like mark, it is not striking and, thus, can be used.

In addition, as the fluorescent substance used as the perceiving substance, there are, for example, inorganic fluorescent compounds comprising zinc sulfide, zinc oxide, cadmium zinc sulfide, cadmium sulfide, calcium sulfide, calcium tungstate or the like. However, since they are white or colored, when the color is the same as that of a portion adjacent to the pattern-like mark, they may be used in some cases. In other cases, even when they are used, the formed images become white or colored as long as their concentrations are not extremely low, which results in the difficulty in the formation of an invisible image.

As the other preferable fluorescent substances, there are, for example, the known fluorescent brightening agent such as stilbenes, diaminophenyls, oxazoles, imidazoles, thiazoles, coumarins, naphthalimides, thiophenes and the like. Also in this case, it is preferred that, as in the ultraviolet absorber, the fluorescent brightening agent has no or small absorption in a visible region, or has no or small emission of fluorescent light by the visible light. The better wavelength region for fluorescent emission is not greater than 380 nm.

The pattern-like mark can be composed of the perceiving substance and the binder described above. As a resin which can be used as the binder, the resins which are substantially transparent to the visible light are preferably used. As such the resin, there may be exemplified thermoplastic resins including: polyethylene resins such as polyethylene (PE), ethylene-vinyl acetate copolymer (EVA) and vinyl chloride-vinyl acetate copolymer; polypropylene (PP); vinyl resins such as polyvinyl chloride (PVC), polyvinyl butyral (PVB), polyvinyl alcohol (PVA), polyvinylidene chloride (PVdC), polyvinyl acetate (PVAc) and polyvinyl formal (PVF); polystyrene resins such as polystyrene (PS), styrene-acrylonitrile copolymer (AS) and ABS; acrylic resins such as polymethyl methracrylate (PMMA) and MMA-styrene copolymer; polycarbonate (PC); cellulose resins such as ethyl cellulose (EC), cellulose acetate (CA), propyl cellulose (CP), cellulose acetate butyrate (CAB) and cellulose nitrate (CN); fluorine resins such as polychlorofluoroethylene (PCTFE), polytetrafluoroethylene (PTFE), tetrafluoroethylene-hexafluoroethylene copolymer (FEP) and polyvinylidene fluoride (PVdF); urethane resins such as polyurethane (PU); nylon resins such as type 6, type 66, type 610 and type 11; polyester resins such as polyethylene terephthalate (PET), polybutylene terephthalate (PBT) and polycyclohexane terephthalate (PCT); and the like.

Furthermore, these resins can be prepared into emulsion for a water paint. As the emulsion for a water paint, there are, for example, vinyl acetate (homo) emulsion, vinyl acetate-acrylic acid ester copolymer resin emulsion, vinyl acetate-ethylene copolymer resin emulsion (EVA emulsion), vinyl acetate-vinyl versateiton copolymer resin emulsion, vinyl acetate-polyvinyl alcohol copolymer resin emulsion, vinyl acetate-vinyl chloride copolymer resin emulsion, acrylic emulsion, acrylic silicone emulsion, styrene-acrylic copolymer resin emulsion, polystyrene emulsion, urethane emulsion, polyolefin chloride emulsion, epoxy-acrylic dispersion, SBR latex and the like.

Alternatively, the binder resin itself may have the ultraviolet absorbing properties or the infrared absorbing properties. The resin having the ultraviolet absorbing functional group may be, for example, a resin such as Tinubin in which an ultraviolet absorber is chemically bonded to the resin. An example of such the resin is, for example, Emulsion Tinubin (manufactured by Chiba Geigy).

The pattern-like mark can be formed on the thermal transfer sheet or the lead film by blending the above perceiving substance and binder and, if necessary, additives and a solvent to prepare a coating composition, and then coating it by the previously known printing method, for example, gravure printing, offset printing, letterpress printing, flexographic printing, silk screen printing or the like.

In addition, mention may be made of the pattern-like mark having the magnetic properties.

The pattern-like mark having the magnetic properties may be composed of magnetic powders and a resin binder. The magnetic powders may be hard magnetic or soft magnetic powders if they are ferromagnetic powders. As the hard magnetic powders, there are, for example, magnetic fine particles such as $\gamma$-$Fe_2O_3$, Co adhered $\gamma$-$Fe_2O_3$, $Fe_3O_4$, Fe, Fe—Cr, Fe—Co, Co—Cr, Co—Ni, Ba ferrite, Sr ferrite, $CrO_2$ and the like.

Examples of the soft magnetic powders may include: a magnetic alloy material comprising Al, Si, or Fe and the like; a high magnetism-permeability metallic material such as Permalloy, Sendust, Fe and the like; ferrite such as Mn—Zn ferrite, Co—Zn ferrite, Ni—Zn ferrite and the like; magnetic fine particles such as amorphous metallic material; and the like.

As a resin binder (or ink vehicle) in which the above magnetic powders are dispersed, there may be used butyral resin, vinyl chloride/vinyl acetate copolymer resin, urethane resin, polyester resin, cellulose resin, acrylic resin, styrene/maleic acid copolymer resin and the like. If necessary, a rubber resin such as nitrile rubber and the like or urethane elastomer and the like are added thereto. Alternatively, taking the heat resistance into consideration, a resin having a high glass transition point (Tg) such as polyamide, polyimide, polyether sulfone and the like, or a resin system in which Tg is raised by the curing reaction can be used. As necessary, a surfactant, a silane coupling agent, a plasticizer, a wax, a silicone oil, a pigment such as carbon and the like may be added to a dispersion in which the magnetic powders are dispersed in the above resin or the ink vehicle.

The pattern-like mark of a magnetic coating layer is formed by preparing a magnetic coating agent containing the aforementioned magnetic powders and the resin binder which is coated on the thermal transfer sheet or the lead film and dried. The various known coating methods such as silk screen printing method, gravure method, roll method, knife edge method and the like can be used.

For reading the magnetic pattern, a magnetic head wound with two coils is usually used. The constant current is flown through one of the magnetic coils of the magnetic head, and the induced current or voltage induced when the magnetic head scans the magnetic pattern is detected by the other coil. The induced current is produced depending upon the change in magnetic flux of the magnetic head.

In addition, mention be made of the pattern-like mark containing an electrically conductive material and, thus having the electrical conductivity. The pattern-like mark in this case can be detected electrically. For example, the mark as an electrically-conductive layer can be formed with the use of an electrically-conductive ink containing metal powders or carbon and a resin binder or a metal foil. The pattern-like mark using the above electrically-conductive material can be detected by adjusting its surface electric resistance to around $10^6$ to $10^9$ ohm/□ and measuring the change in the electric resistance relative to the electric resistance of a portion adjacent to the pattern-like mark.

The pattern-like mark having the electrical conductivity may be provided at a front end of the thermal transfer sheet itself or at the lead film adhered to a front end of the thermal transfer sheet. Alternatively, if an ink to be used for formation of a thermally transferable layer of the thermal transfer sheet has electrical conductivity, such an ink can be used to form the pattern-like mark having the electrical conductivity at a front end of the thermal transfer sheet.

Furthermore, the pattern-like mark can be provided on all the side of the thermal transfer sheet in a solid manner. In this case, for example, when the ink used in the thermally transferable layer is electrically conductive, the thermally transferable layer may serve as the pattern-like mark. When the ink used in a rear layer is electrically conductive, the rear layer may serve as the pattern-like mark.

In addition, mention be made of the pattern-like mark having the electromagnetic properties to microwave. A portion of the thermal transfer sheet or the lead film where the pattern-like mark is not formed, that is, a portion adjacent to the pattern-like mark is formed of a non-electrically conductive material, thus having no electromagnetic properties to microwave. To the contrary, the pattern-like mark portion of this type contains an electromagnetic material, for example, a conductive metal such as Al and Ni, and an electrically conductive particles such as electrically conductive fibers.

The above pattern-like mark having the electromagnetic properties to microwave can be formed by a plating method to form a metal vapor into a thin metal layer, such as vacuum deposition, sputtering, low temperature plasma method or the like, or by the previously known coating method of a coating solution containing an electrically conductive material.

In addition, when the electrically conductive material is encapsulated into a microcapsule to form a coating solution, the electrically conductive material is easily dispersed in a coating solution, being preferable.

When the thermal transfer sheet provided with the above pattern-like mark having the electromagnetic properties to microwave is scanned with microwave, since specific inductive capacity $\epsilon$, permeability $\mu$, resistivity $\rho$ and the like are different between two portions of the non-electrically conductive material and the electrically conductive material, the change occurs in response microwave flux, that is, reflection flux or permeability flux and, thus, it can be read that the thermal transfer sheet is authentic by detecting the change. Accordingly, the invisible mark of this type can be detected by changing the electromagnetic properties in response to microwave.

As the above pattern-like mark, there are marks having the particular optical properties in a visible light region, an ultraviolet ray region or an infrared region, having the magnetic properties, having the electrical conductivity, or having the electromagnetic properties in response to the microwave. In any cases, the pattern shape may be line, bar code or letter, circle, ellipse, triangle, rectangle, polygon, trade mark or the like, or a combination of two or more of them. The pattern shape can be arbitrarily selected depending upon an sensor which reads the pattern shape.

Alternatively, in the invention of the first aspect, a circuit which makes a resonance with high frequency wave (resonance circuit, LC circuit) can be used as a mark coded from the approval information. The resonance circuit makes a resonance with transmitted high frequency wave and dispatches an echo wave, and the detection can be conducted by receiving the echo wave.

The resonance circuit is composed of a dielectric support and a coil circuit and a condenser, each of which is formed on a different side of the dielectric support, and thus makes a resonance with high frequency wave (electromagnetic wave and the like). The resonance circuit may be in the card-like shape in which the resonance circuit is mounted on a dielectric substrate, or in the chip-like small shape, and the shape thereof is not limited to the specified ones. Such a resonance circuit may be fixed on the thermal transfer sheet in the first aspect of the present invention.

For example, a metal foil is laminated on both sides of a dielectric film and the metal foil layer is formed in the coil-like pattern or the condenser pattern by etching treatment or printing treatment to form a resonance circuit.

A reader for the resonance circuit transmits the electromagnetic wave having the particular frequency. On the other hand, the resonance circuit makes a resonance with the electromagnetic wave having the same frequency, and dispatches an echo wave. Thus, the thermal transfer sheet having the resonance circuit is detected by the reader and the detected reception signal is converted into a signal which initiates the actuation of a thermal transfer printer. By using a coil which makes a resonance with the specific frequency, the approval mark comprising the resonance circuit is identified to be regular such that it received approval by a printer manufacturer or the like.

The resonance circuit may record an additional information as well as the approval mark. For example, the number of usable image planes of a thermal transfer sheet can be recorded on the resonance circuit, and in can be read by the same reader as for the approval mark or a different reader. In addition, for example, the setting of the number of usable image planes of a thermal transfer sheet can be controlled by using a plurality of coils which make a resonance with some different frequencies and combining the resonance frequencies to form a multichannel.

(Lead Film)

As the lead film 3 used in the present invention, a film composed of the same material as that of the substrate film of the thermal transfer sheet can be used. The thickness of the lead film 3 is usually 4 to 50 $\mu$m, preferably around 10 to 30 $\mu$m. In addition, the length of the lead film can be appropriately set.

In order to connect the thermal transfer sheet and the lead film, the previously known means such as a double-coated tape, a pressure-sensitive adhesive tape and the like can be used.

The dimension such as internal diameter, the outer diameter, the length and the like of a bobbin used in the present thermal transfer sheet, whether for supply or rolling up, can be appropriately set depending upon a cassette and a thermal transfer printer on which the thermal transfer sheet is mounted. In addition, as a material constituting the bobbin, there may be used a paper, plastic, a paper impregnated with a resin and the like, and the materials which have been previously used for the bobbin may be used.

The adherence of the thermal transfer sheet to the above bobbin and the adherence of the lead film to the bobbin can be conducted using any material such as a double-coated tape, a pressure-sensitive adhesive tape, an adhesive and the like.

The present thermal transfer sheet is not limited to the above embodiments and can be composed of various thermal transfer sheets and lead films without departing the present invention.

(Recording Method and Recording System)

A recording method and recording system of the first aspect is to read the mark identifying that the thermal transfer sheet is authentic by means of a determinator, and to initiate recording by interlocking the printer with the determinator.

Figure 4:
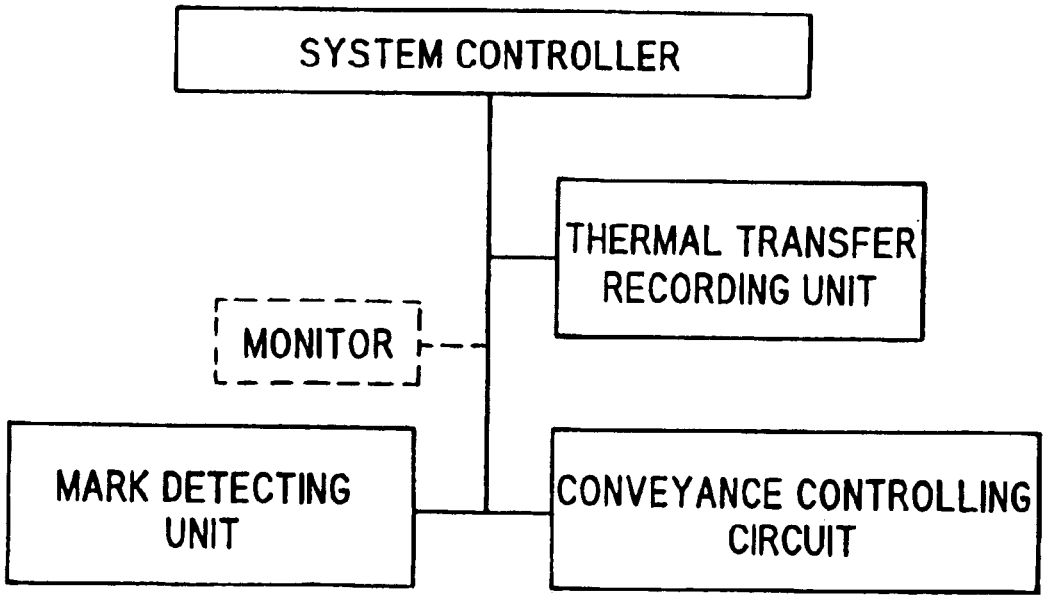
FIG. 4 is a block diagram showing one embodiment of an electrical construction of a thermal transfer printer using a recording method of the first aspect in accordance with the present invention.

For example, in the present recording method and system, when a thermal transfer sheet which received approval of the quality assurance for a thermal transfer printer, that is, an authentic thermal transfer sheet is set on the printer, a mark detecting unit detects the pattern-like mark at a front end of the thermal transfer sheet as shown in FIG. 4. Scatter of the detection values of the mark and/or misoperation may be caused depending on the difference of the optical properties of a visible light region, an ultraviolet ray region or an infrared ray region, or the magnetic properties, or the electrical properties, or the electromagnetic properties to microwave between the pattern-like mark and a portion adjacent thereto, or depending on an echo strength of the resonance circuit. Accordingly, taking such scatter of the detection values and misoperation into consideration, the mark detection level is set in advance, and this mark detection level is memorized in a system controller. In some cases, when the pattern-like mark is solid-coated on all the side of the thermal transfer sheet, the detection level of the initial set with the mark detecting unit is determined in advance.

Next, the detection level of the mark actually detected with the above mark detecting unit is compared with the mark detection level memorized in the system controller and, when the actual level detected with the mark detecting unit is above the mark detection level memorized in the system controller, it is determined that the thermal transfer sheet having that mark is authentic. In this example, the mark detecting unit and the system controller cooperate to determine the mark. In addition, when the mark has the inherent information such as a bar code and the like, the number of recordable image planes of that thermal transfer sheet (the usable number) is recorded as the inherent information, the information of the number of the usable image planes is read with the mark detecting unit, and the information of the number of the image planes is memorized in the system controller of the thermal transfer printer body.

Then, after it is determined that the thermal transfer sheet is authentic, a command is issued from a conveyance controlling circuit to convey the thermal transfer sheet from the supply side to the discharge side and place it at a thermal transfer recording unit and, thermal transfer recording is thus conducted. Thereafter, the thermal transfer recording is continued until the number of the usable image planes memorized in the system controller. However, when the recording is conducted above the number of the usable image planes memorized in the system controller, a caution message such as "Exchange a thermal transfer sheet" is displayed in a monitor, or the thermal transfer printer is stopped.

On the other hand, when a thermal transfer sheet which did not receive approval of the quality assurance for a thermal transfer printer, that is, a pirated thermal transfer sheet is set on that printer, the operation of the mark detecting unit is conducted at a front end of the thermal transfer sheet, but since the exclusive mark is not present, the mark detection is not conducted above mark detection level memorized in the system controller.

Hence, it is determined that the thermal transfer mark is not authentic, an direction to convey the thermal transfer sheet from the supply side is not issued from the conveyance controlling circuit and the thermal transfer printer remains stopped. Alternatively, a caution message such as "Exchange a thermal transfer sheet with an authentic article" is displayed in a monitor in some cases.

EXAMPLES

The following Examples and Comparative Examples illustrate the present invention in more detail.

Example A Series

Example A-1

A heat meltable ink layer of tint black having the dried thickness of 4.0 μm was formed on one side of a polyethylene terephthalate film having the thickness of 6 μm as a substrate film with a gravure coater, and a rear layer was formed on the other side of the substrate film in advance, to prepare a thermal transfer sheet.

Next, an infrared absorbing offset ink with the conditions below was prepared, and with this ink, a bar code as a pattern-like mark identifying an authentic article was offset-printed on one side of a polyethylene terephthalate film having the thickness of 12 μm as a substrate film to prepare a lead film.

Infrared Absorbing Offset Ink 200 parts by weight of ytterbium phosphate finely-divided powders (manufactured by Shinetsu Kagaku) was heated to calcinate in an electric furnace (atmosphere: air, normal pressure) at 80° C. for 2 hours. Then, to heated and calcinated ytterbium phosphate was added 200 parts by weight of toluene to obtain a slurry, and 2 parts by weight of a silane coupling agent (γ-methacryloxypropyltrimethoxysilane, manufactured by Shinetsu Kagaku) was further added. This slurry was wet-ground with a ball mill at 1000 rpm for 100 minutes. The surface-treated ytterbium phosphate was recovered as a wet cake (solid content 72%) by centrifugation (3500 rpm, 30 minutes).

17 parts by weight of this wet cake (solid content 72%) was added to and mixed with an offset vehicle comprising 2 parts by weight of acrylate monomer, 4 parts by weight of acrylate oligomer, 3 parts by weight of a wax and 0.5 part by weight of a sentisizer, which was flashed in a vacuum blender to remove a solvent component, to prepare an infrared absorbing offset ink.

One end of the above thermal transfer sheet having the width of 220 mm was adhered to a supply bobbin, which was made of a paper (paper tube) and had the internal diameter of 25 mm, the external diameter of 32 mm and the length of 220 mm, and the thermal transfer sheet was rolled up the supply bobbin. Next, the above lead film having the width of 220 mm was connected to an end of the final rolling of the rolled up thermal transfer sheet with an adhesive tape having the width of 18 mm. Furthermore, A bobbin for rolling up was adhered to a front end of the lead film with an adhesive tape having the width of 24 mm. The bobbin for rolling up to be used was similar to that for supply. Thus, the thermal transfer sheet of Example A-1 was obtained.

Example A-2

A heat meltable ink layer of tint black having the dried thickness of 4.0 $\mu$m was formed on one side of a polyethylene terephthalate film having the thickness of 6 $\mu$m as a substrate film with a gravure coater, and a rear layer was formed on the other side of the substrate film in advance, to prepare a thermal transfer sheet.

Then, a fluorescent ink with the following conditions was prepared, and a bar code as a pattern-like mark identifying an authentic article was printed on the rear layer of the above substrate film at a position of a front end of the thermal transfer sheet by means of an air less spraying coating machine (Nordson select coat system) using the above ink.

| Fluorescent Ink | |
|---|---|
| Fluorescent dye (Transparent fluorescent brightening agent, UVITEX OB, manufactured by Chiba Geigy) | 1 Part by weight |
| Polyester resin (BYRON 200, manufactured by Toyoboseki) | 29 Parts by weight |
| Methyl ethyl ketone | 35 Parts by weight |
| Toluene | 35 Parts by weight |

Then, one end of the above thermal transfer sheet having the width of 220 mm was adhered to a supply bobbin, which is made of a paper (paper tube) and had the internal diameter of 25 mm, the external diameter of 32 mm and the length of 220 mm with an adhesive tape having the width 24 mm, and the thermal transfer sheet was rolled up on the supply bobbin. Next, a bobbin for rolling up was adhered to an end of the final rolling of the rolled up thermal transfer sheet with an adhesive tape having the width of 24 mm. The bobbin for rolling up to be used was similar to that for supply. Thus, the thermal transfer sheet of Example A-2 was obtained.

Comparative Example A-1

A heat meltable ink layer of tint black having the dried thickness of 4.0 $\mu$m was formed on one side of a polyethylene terephthalate film having the thickness of 6 $\mu$m as a substrate film with a gravure coater, and a rear layer was formed on the other side of the substrate in advance, to prepare a thermal transfer sheet.

Then, one end of the above thermal transfer sheet having the width of 220 mm was adhered to a supply bobbin, which is made of a paper (paper tube) and had the internal diameter of 25 mm, the external diameter of 32 mm and the length of 220 mm with an adhesive tape having the width of 24 mm, and the thermal transfer sheet was rolled up on the supply bobbin. Next, a bobbin for rolling up was adhered to an end of the final rolling of the rolled up thermal transfer sheet with an adhesive tape having the width of 24 mm. The bobbin for rolling up to be used was similar to that for supply. Thus, the thermal transfer sheet of Comparative Example 1 was obtained.

A pattern-like mark identifying an authentic article was not formed on the thermal transfer sheet of Comparative Example A-1.

Each of the thermal transfer sheets of Examples and Comparative Example was set on an a thermal transfer printer for exclusive use and an operation for initiation of printing was conducted.

(Results of Evaluation)

In the thermal transfer sheet of Comparative Example, since a pattern-like mark for exclusive use was not present, the mark detection was not conducted above the mark detection level memorized in a system controller and the thermal transfer printer remained stopped and printing was not initiated.

To the contrary, in the thermal transfer sheet of Example A-1, a mark detecting unit having an infrared sensor detected the pattern-like mark (bar code), and the printing of thermal transfer was initiated. Since the bar code had an inherent information of the number of recordable image planes, the thermal transfer recording could be conducted with an appropriate printing quality until the end of the number of the image planes.

In addition, in the thermal transfer sheet of Example A-2, the mark detecting unit having an ultraviolet sensor detected a pattern-like mark (bar code), and the printing for thermal transfer was initiated. Since the bar code has an inherent information of the number of recordable image planes, the printing for thermal transfer could be conducted with appropriate printing quality until the end of the number of the image planes.

Next, the second aspect of the present invention will be explained.

Figure 5:
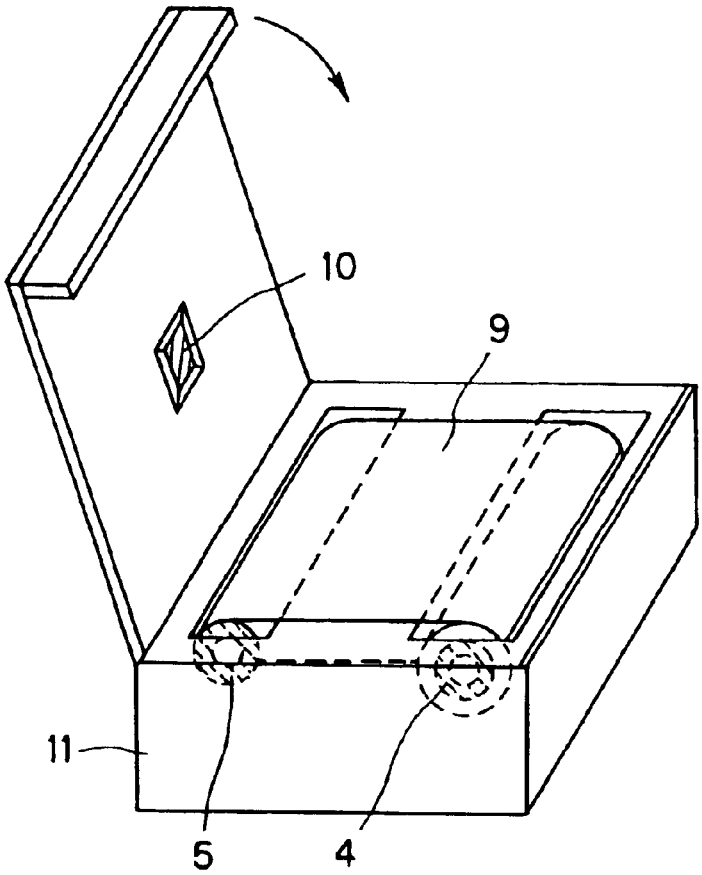
FIG. 5 is a perspective view showing one embodiment of a thermal transfer sheet with a card of the second aspect in accordance with the present invention.

As one embodiment of a thermal transfer sheet belonging to the second aspect, mention may be made of a thermal transfer sheet 9 shown in FIG. 5.

As shown in FIG. 5, a bobbin for rolling up 5 is adhered to an end of the final rolling of a thermal transfer sheet 9 which has been rolled up on a bobbin for supply 4. One thermal transfer sheet 9 and one approval card 10 are contained in one case 11 so that one approval card 10 was combined with one thermal transfer sheet 9.

A code showing the number of usable image planes and showing that the approval card was regular as being approved by a printer manufacturer or the like is recorded on the approval card by a invisible mark.

In addition, the thermal transfer sheet of the present invention can take the similar form to that of FIG. 5, in which an IC card is equipped in place of the approval card. The IC card had an integrated circuit. A code showing the regularity as being approved by a printer manufacturer or the like has been recorded on the integrated circuit in advance. The predetermined signal is sent from a card reader to the IC card and, thus, the regularity of the IC card is approved by detecting a signal produced from the integrated circuit of the IC card in response to the sent signal. In addition to the approval code, the number of usable image planes may be electrically recorded in advance on the integrated circuit and, if necessary, the number of usable image planes was successively decreased and recorded every use of the thermal transfer sheet.

Previously, as a general perceiving medium, a plastic card provided with a magnetic stripe recording a prescribed code has been used. Alternatively, a key has been generally used for the perceiving medium.

However, the contents of the previous magnetic card can be read out relatively easily by contacting a magnetic head with a stripe and the card can be falsified. A key has the characteristics in the shape and a duplicate key can be easily made. Furthermore, when a magnetic card approaches a magnetic material, the recorded contents go out and the magnetic card dose not play a role as the specific perceiving card. In addition, previously, there is a card on which a pattern observable with the visible light is printed and which is read by a bar code and this card can be easily falsified.

The second aspect dose not use the aforementioned previous cards and use an approval card on which the number of usable image planes of a thermal transfer sheet and a code showing that the card is regular as being approved by a printer manufacturer or the like is recorded by an invisible mark, or alternatively use an IC card having an integrated circuit, on which the number of usable image planes is electrically recorded in advance and a code showing the regularity as being approved by a printer manufacturer or the like is recorded. Further, the number of usable image planes may be successively decreased every use. By using such the cards, it is difficult to falsify the cards and the contents recorded in the cards can not be easily vanished.

The thermal transfer sheet of the second aspect is a thermal transfer sheet with an approval card or a thermal transfer sheet with an IC card, in which an approval card having an invisible mark or an IC card is combined with the thermal transfer sheet at one versus one.

Cards which play an important role in the invention of the second aspect will be explained below.

First, the approval card is a card in which an invisible mark is applied on a cad substrate. As example of the card substrate, there may include: a plastic sheet such as a polyvinyl chloride resin sheet, a polystyrene resin sheet, a polyolefin resin sheet (a polyethylene resin sheet, a polypropylene resin sheet and the like), a polyethylene terephthalate sheet and the like; a paper such as a synthetic paper (polyolefin, polystyrene) or a natural paper; a metal sheet; glass; and a sheet obtained by laminating two or more materials of them.

As an invisible mark which is applied on the above card substrate, there are, for example, those having the particular optical properties in an ultraviolet ray region or an infrared ray region, and which absorbs the light of those wavelength regions or emits the fluorescent light in response to an irradiated light. The invisible mark is not read in the visible light region and is an invisible information. It goes without saying that "absorption" herein is required not to be the same absorbing properties at these wavelength regions as those of a portion of the card where the invisible mark is not applied. If it is the same, the invisible mark formed on the card has no difference in the properties regarding the light of these wavelength regions and becomes unperceivable. In addition, the wavelength regions may be the wavelength region of only ultraviolet ray, of only infrared ray, or of both ultraviolet ray and infrared ray.

Therefore, it is difficult to falsify the approval card of the present invention having the invisible mark and the contents recorded on the card can not be easily vanished.

In the case where an invisible mark is formed on a transparent card substrate, the invisible mark may be perceived not by an amount of the reflected light of the particular wavelength but by an amount of the transmitted light. In such the case, an amount of the transmitted light is decreased by shield depending upon the absorbing properties and the mark can be perceived by the decreased amount of the transmitted light.

Materials which form the invisible mark are not limited to but include those having the particular optical properties in an ultraviolet ray region or an infrared region.

More particularly, the same materials as those used in the first aspect described above can be also used in the second aspect as a perceiving substance.

And the invisible mark can be composed of the perceiving substance and an appropriate binder. As the binder, a resin which is substantially transparent to the visible light is preferable. Specifically, the same binder resins as those which are combined with the perceiving material in the first aspect can be also used in the second aspect. Like the first aspect, the binder resin may be the form of emulsion for a water paint. The binder resin itself may have the ultraviolet absorbing properties or the infrared absorbing properties as in the first aspect.

A coating method may be the same as that of the first aspect. The invisible mark can be formed on the card substrate by blending a perceiving substance and a binder and, if necessary, additives and a solvent, and coating the prepared coating composition on the card substrate with the previously known printing method, for example, gravure printing, offset printing, letterpress printing, flexographic printing, silk screen printing or the like.

Such the invisible mark may have the mark shape of line, bar code or letter, circle, ellipse, triangle, rectangle, polygon, trade mark and the like, or a combination of two or more of those shapes. The mark shape can be arbitrarily selected depending upon a sensor which reads the shape.

Alternatively, in the invention of the second aspect, a circuit which makes a resonance with high frequency wave (resonance circuit, LC circuit) can be used as a mark coded from the approval information. The resonance circuit makes a resonance with transmitted high frequency wave and dispatches an echo wave, and the detection can be conducted by receiving the echo wave.

That is, an approval card which is used as a thermal transfer sheet with the approval card of the present invention may be a card having a circuit (resonance circuit, LC circuit) which is provided with a coil and a condenser and thus makes a resonance with high frequency wave (electromagnetic wave and the like).

That is, the approval card having the resonance circuit may be in the card-like shape in which the resonance circuit is mounted on a substrate, or in the chip-like small shape, and the shape thereof is not limited to the specified ones.

For example, a metal foil is laminated on both sides of a dielectric film and the metal foil layer is formed in the coil-like pattern or the condenser pattern by etching treatment or printing treatment to form a resonance circuit.

The thus formed resonance circuit can be adhered on the card substrate. Alternatively, the resonance circuit may be unitedly formed in the approval card by forming the coil-like pattern and the condenser pattern on respective side of the card substrate as the dielectric film.

A reader for an approval card having such the resonance circuit transmits the electromagnetic wave having the particular frequency. On the other hand, the resonance circuit makes a resonance with the electromagnetic wave having the same frequency, and dispatches an echo wave. The approval card having the resonance circuit is detected by the card reader and the detected reception signal is converted into a signal which initiates the actuation of a thermal transfer printer. By using a coil which makes a resonance with the specific frequency, the approval card having the resonance circuit is identified to be regular such that it received approval by a printer manufacturer or the like.

In addition, for example, the setting of the number of usable image planes of a thermal transfer sheet can be controlled by using a plurality of coils which make a resonance with some different frequencies and combining the resonance frequencies to form a multichannel.

As the IC card, the previously known IC cards can be used. Either the IC card which is non-contact type at reading and in which an antenna, an IC chip, a coil or the like is provided on a card substrate and this member is covered with a covering material, and the IC card which is contact type at reading and in which an outer connecting terminal is exposed on the card surface having an IC chip, a coil or the like may be used.

The IC chip is an integrated circuit in which CPU, memory and the like are connected by wiring. A code showing authentic as being approved by a printer manufacturer is recorded on the integrated circuit. Furthermore, the number of usable image planes may be electrically recorded in advance on the integrated circuit. The number of usable image planes may be successively decreased and recorded every use.

Some additional data can be recorded on the IC chip besides the aforementioned number of usable image planes and a code showing an authentic article. Examples of such an additional data include data regarding a thermally transferable layer of a thermal transfer sheet, for example, data obtained by conducting a printing test on every thermal transfer sheet, measuring the density of the print and calculating data to be corrected based on the result, in order to prevent a respect that reproduction of the prescribed gradation regarding the transfer density is not obtained although the printing conditions on a thermal transfer printer are the same.

The data regarding a thermally transferable layer of a thermal transfer is preferably used, particularly, for a multicolored sublimation dye ink layer using two or more colors.

The IC chip may record an additional data by which printing conditions of a thermal transfer printer side is changed and adjusted every trouble which is previously expected when a printing trouble occurs on the ground of a thermal transfer sheet during printing with a thermal transfer printer.

In addition to recording of the fixed information as described above on the IC chip, the following information may be recorded and renewed thereon.

It is preferred that the number of usable image planes is previously electrically recorded and the number of usable image planes is successively decreased and recorded every use of a thermal transfer sheet corresponding to the IC chip. In this case, the predetermined operation is conducted with CPU of the IC chip to renew the recorded data.

In addition, when printing trouble occurs during printing with a thermal transfer printer, the number of usable image planes of a thermal transfer sheet which proved fruitless may be subtracted from the number of usable image planes to renew the record.

In the present invention, the IC card described above can be used. The external shape thereof is not limited to the shape in which the IC chip is provided on a card substrate, and only a component in which the IC chip and an input-output terminal are connected via a conductive material can exert its function and can be used in the present invention.

Therefore, the IC card in the present invention is intended to include only an component in which the IC chip and an input-output terminal are connected via a conductive terminal.

In the invention of the second aspect, as a thermal transfer sheet which is combined with an approval card or an IC card, the sheets having the previously known construction can be used.

The thermal transfer sheet is a sheet in which a heat meltable ink layer or a sublimation dye ink layer is provided on a substrate. The heat meltable ink layer and the sublimation dye ink layer may be provided on a separate substrate, respectively, or present on the same substrate.

The above thermally transferable layers can both form a monocolor and a multi-color image. In the case of a multicolor image, thermally transferable layers of three colors or four colors of yellow, magenta, cyan and, if necessary, black can be coated on the same substrate successively in a plane-order manner or in a stripe manner parallel with a flow direction of a continuous thermal transfer sheet.

More particularly, the thermal transfer sheet to be endowed with the mark of the first aspect can be also used as it is in the second aspect.

In the invention of the second aspect, the thermal transfer sheet and the approval card or the IC card are combined at one versus one, and they must be not incorrectly combined. For example, on a card on which the number of usable image planes and a code showing authentic as being approved by a printer manufacturer are recorded, and on a position (a front part) of a thermal transfer sheet corresponding thereto where the use of the thermal transfer sheet is to be initiated, a code common to the both is recorded, and each code is read with a card reader in the case of the card and with an exclusive sensor in the case of thermal transfer sheet. Thus, only when both coincide with each other, a thermal transfer printer can be actuated.

In a bobbin used in the present thermal transfer sheet, whether for supply or for rolling up, the dimension such as the internal diameter, the external diameter, the length and the like of the bobbin can be appropriately selected depending upon a cassette on which a thermal transfer sheet is mounted and a thermal transfer printer. The bobbin may be made of a paper, a plastic, a paper impregnated with a resin or the like, and the materials which have been previously used for bobbins can be used for the second aspect.

The thermal transfer sheet is usually rolled on a bobbin for supply and a bobbin for rolling up shown in FIG. 5. The thermal transfer sheet may be contained in a cassette case for exclusive use and, after using, the cassette case may be reused and the thermal transfer sheet may be exchanged with another one. Alternatively, without the above cassette case for exclusive use, the thermal transfer sheet shown in FIG. 5 may be directly mounted on the thermal transfer printer.

Now, in the thermal transfer sheet with the approval card or the thermal transfer sheet with the IC card of the present invention, as shown in FIG. 5, the card may be contained in a case. The card may be applied, for example, on an end plane of the bobbin for supply or the bobbin for rolling up. The card may be peelably adhered to a front end of the thermal transfer sheet wound on the bobbin for supply.

The thermal transfer sheet of the second aspect is not limited to the above embodiments and can be composed of the various thermal transfer sheets and cards without departing the present invention.

(Recording Method and Recording System)

A thermal transfer recording method and recording system of the second aspect uses the aforementioned thermal transfer sheet with the approval card in which the thermal transfer sheet is combined with the approval card at one versus one. The code showing that the approval card is regular as being approved by a printer manufacturer is recorded on the approval card by an invisible mark. The number of usable image planes is preferably recorded on the approval card together with the approval code. By mounting the approval card on a card reader and detecting the invisible mark, when it is determined that the approval card is correct, a thermal transfer printer is actuated in the state where the thermal transfer sheet is set on the printer.

In the present invention, since the thermal transfer sheet and the approval card are combined at one versus one, the regularity of the approval card means that the thermal transfer sheet is a regular authentic article.

In addition, in a thermal transfer recording method and system using the thermal transfer sheet with the IC card, a thermal transfer sheet and an IC card are combined at one versus one, and the IC card has an integrated circuit. A code showing authentic as being approved by a printer manufacturer has been recorded in advance on the integrated circuit. It is preferable that the number of usable image planes has been electrically recorded in advance on the integrated circuit together with the approval code. And by mounting the IC card on a card reader, sending the predetermined signal to the IC card and detecting a signal produced from the integrated circuit of the IC card, when it is determined that the IC card is correct, a thermal transfer printer is actuated in the state where the thermal transfer sheet is set on the printer.

Furthermore, in a thermal transfer recording method and system using the thermal transfer sheet with an IC card, not only the number of usable image planes has been electrically recorded in advance on an integrated circuit, but also the number of usable image planes may be successively decreased and recorded every use. Furthermore, by mounting the IC card on a card reader, sending the predetermined signal to the IC card and detecting a signal produced by the integrated circuit of the IC card in responsive to the signal, when the actually used number of the image planes dose not exceed the original number of usable image planes and the IC card is determined to be correct, the thermal transfer printer can be actuated in the state where the thermal transfer sheet is set on the printer.

When the number of usable image planes is successively decreased every use, the above integrated circuit of the IC card effectively uses the operation of CPU.

Figure 9:
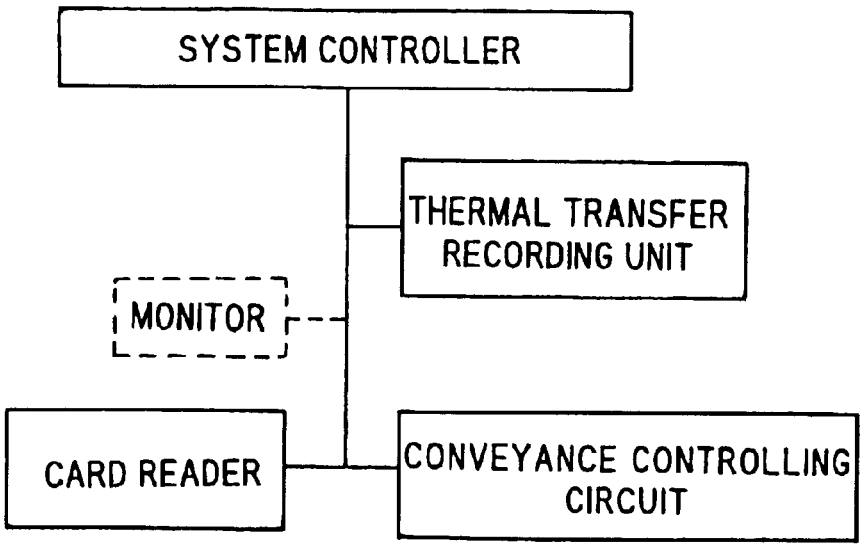
FIG. 9 is a block diagram showing one embodiment of a thermal transfer printer using a thermal transfer recording method of the second aspect in accordance with the present invention.

In the present recording method and system, for example, as shown in FIG. 9, when a thermal transfer sheet which received approval of the quality assurance for a thermal transfer printer, that is, an authentic thermal transfer sheet is set on that printer and an approval card corresponding to that thermal transfer sheet at one versus one is mounted on a card reader, the card reader detects the invisible mark of the approval card. Scatter of the detection values of the mark and/or misoperation may be caused depending on the difference of the optical properties of an ultraviolet ray region or an infrared ray region between the mark and a portion adjacent thereto, or depending on an echo strength of the resonance circuit. Accordingly, taking such scatter of the detection values and misoperation into consideration, the mark detection level is pre-set, and this mark detection level is memorized in a system controller. In some cases, when the pattern-like mark is solid-coated on all the side of the card, the detection level of the initial set with the mark detecting unit is determined in advance.

Alternatively, the detection may be conducted by using a circuit which makes a resonance with high frequency as an invisible mark, emitting an echo wave by resonance with high frequency and receiving the echo wave with a reader.

Next, the detection level of the mark detected with the above reader and the mark detection level memorized in the system controller are compared, and when the detected mark level is above the memorized mark level, it is determined that a card having the mark is authentic. In addition, when the mark shows the number of recordable image planes (the usable number) of that thermal transfer sheet as an inherent information, the information of the number of image planes is read with a card reader and the information of the number of image planes is memorized in a system controller of a thermal transfer printer.

And, after the thermal transfer sheet is determined to be an authentic article, a command is issued from a conveyance controlling circuit to convey the thermal transfer sheet from the supply side to the discharge side, and place it at a thermal transfer recording unit, and then thermal transfer recording is performed. Thereafter, the thermal transfer recording is continued until the number of image planes memorized in the system controller. However, when recording is performed over the number of image planes memorized in the system controller, a caution message such as "Exchange a thermal transfer sheet" may be displayed on a monitor or the thermal transfer printer may stops.

On the other hand, when a thermal transfer sheet which did not receive approval of the quality assurance for a thermal transfer printer, that is, a pirated thermal transfer sheet is set on that thermal transfer printer, and when an approval card corresponding to that thermal transfer sheet at one versus one is mounted on a card reader, an operation of detecting a mark is conducted but since a mark for exclusive use is not present, the mark detection over the mark detection level memorized in the system controller is not conducted.

Hence, the thermal transfer sheet is determined not to be an authentic article, a command to convey the thermal transfer sheet from the supply side is not issued and the thermal transfer printer remains stopped. Alternatively, a caution message such as "Exchange a thermal transfer sheet with an authentic one" is displayed.

Figure 6:
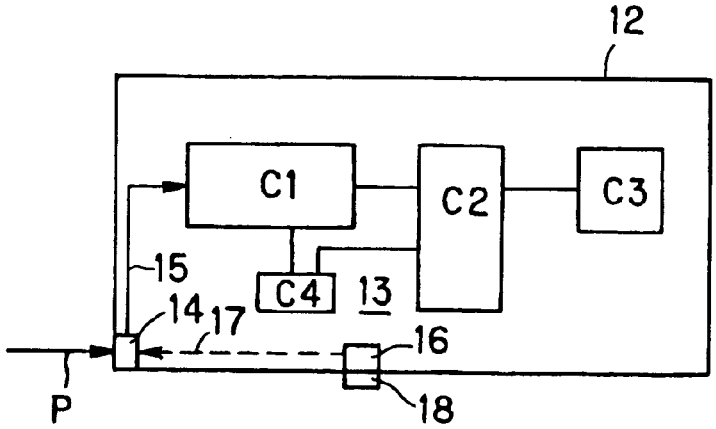
FIG. 6 is a block diagram showing one embodiment of a thermal transfer recording method of the second aspect in accordance with the present invention and showing the relationship between a thermal transfer printer, a card reader and a controlling means.

FIG. 6 is one embodiment showing the relationship between a thermal transfer printer and a card reader. A reference numeral 12 is a thermal transfer printer, and the interior thereof is constituted of a hardware 13 composed of components C1, C2, C3 and C4. The above hardware 13 is given an actuation signal 15 by a controlling means 14. A reference numeral 16 is a card reading signal generator, and a reference numeral 17 is a reading signal which is given to the controlling means 14. A reference numeral 18 is a card reader and is provided outside a thermal transfer printer 12. P is a source line.

In the above construction, a card not shown (an approval card or an IC card, a card which is subjected to a thermal transfer sheet to be used in that thermal transfer printer at one versus one) is inserted into a card reader 18, it is confirmed that the inserted card is regular as being approved by a printer manufacturer or the like and, in the case of the IC card, the card dose not exceed the number of usable image planes, an output 15 is produced from a controlling means 14, and a thermal transfer printer 12 is actuated in the state where a thermal transfer sheet is set thereon.

Figure 7:
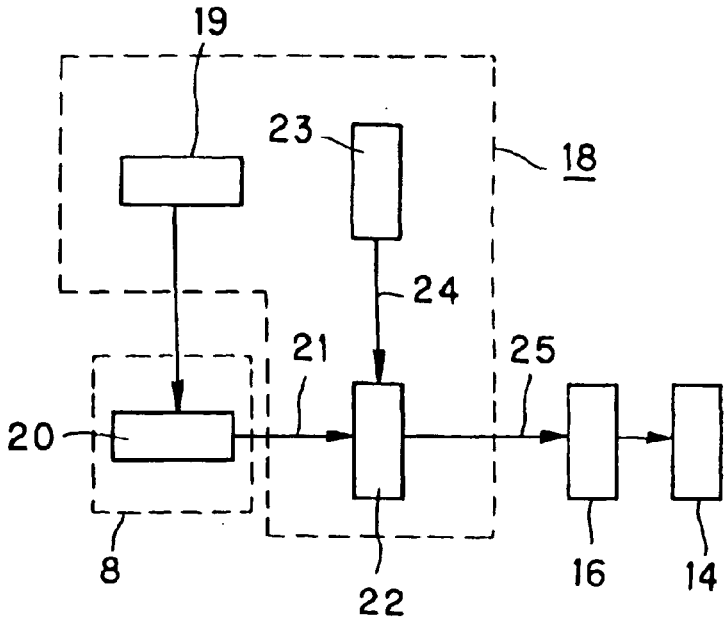
FIG. 7 is a block diagram showing one embodiment of a thermal transfer recording method of the second aspect in accordance with the present invention and showing the relationship between a thermal transfer printer and a card reader.

Next, FIG. 7 is an another embodiment showing the relationship between a thermal transfer printer and a card reader. A signal generator 19 of a card reader 18 produces the predetermined signal, which is given to an IC chip 20 and, in response thereto, an IC chip 20 produces the particular signal 21 (a code signal showing the regularity as being approved by a printer manufacturer), which is given to a coincidence circuit 22. A register code 24 recorded in a memory 23 of the card reader 18 is given to this coincidence circuit 22 and, when a code signal 21 coincides with a register code 24, an output 25 is issued and the output is given to the controlling means 14 as explained in FIG. 6 via a card reading signal generator 16.

Figure 8:
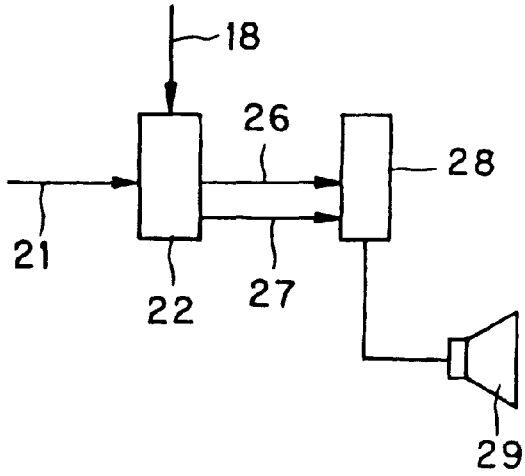
FIG. 8 is a block diagram showing one embodiment of a thermal transfer recording method of the second aspect in accordance with the present invention and showing the relationship between a thermal transfer printer and a card reader.

FIG. 8 is a still another embodiment showing the relationship between a thermal transfer printer and a card reader. Two outputs 26 and 27 of a coincidence circuit 22 are given to a voice synthesizing output apparatus 28, the apparatus 28 produces a voice signal corresponding to coincidence or non-coincidence in a coincidence circuit 22, which makes a speaker 29 to produce a sound. That is, when a code signal 21 and s register code 24 coincide, an output 26 is given to a voice synthesizing output apparatus 28, which produces a voice corresponding to initiation of printer actuation OK, while when the code signal dose not coincides therewith, output 27 is given to a voice synthesizing output apparatus 28, which produces a voice that actuation of a printer can not be performed.

Alternatively, a monitor may be used in place of the above voice synthesizing output apparatus to display a necessary information on a display.

In a thermal transfer recording method of the invention of the second aspect, whether the thermal transfer sheet with the approval card or the thermal transfer sheet with the IC card, after a card inserted into a card reader is read of a code showing the number of usable image planes and the regularity as being approved by a printer manufacturer, and after a thermal transfer sheet is used until the final number of image planes, a code (register code) showing the regularity as being approved by a printer manufacturer may be vanished inside or outside a card reader. It is preferable to makes impossible the reuse of a card which has been used until the final image plane, as it is. In stead of deletion of the above register code, the number of usable image planes may be recorded and renewed to be "0".

In the foregoing thermal transfer sheet with the approval card, the thermal transfer sheet with the IC card, the thermal transfer recording method and the system, a code showing the number of usable image planes and the regularity as being approved by a printer manufacturer is recorded on the approval card and the IC card. However, it is also possible that only a code of the regularity as being approved by a printer manufacturer is recorded without recording the number of usable image planes.

EXAMPLES

The following Examples and Comparative Examples illustrate the invention of the second aspect in more detail.

Example B-1

A heat meltable ink layer of tint black having the dried thickness of 4.0 μm was formed on one side of a polyethylene terephthalate film having the thickness of 6 μm as a substrate film with a gravure coater, and a rear layer was formed on the other side of the substrate film in advance, to prepare a thermal transfer sheet.

Next, an infrared absorbing offset ink with the conditions below was prepared, and with this ink, a bar code as an invisible mark showing the number of usable image planes and the regularity as being approved by a printer manufacturer was offset-printed on one side of a polyethylene terephthalate film having the thickness of 125 μm as a card substrate to prepare n approval card.

Infrared Absorbing Offset Ink 200 parts by weight of ytterbium phosphate finely-divided powders (manufactured by Shinetsu Kagaku) was heated to calcinate in an electric furnace (atmosphere: air, normal pressure) at 80° C. for 2 hours. Then, to heated and calcinated ytterbium phosphate, 200 parts by weight of toluene was added to obtain a slurry, and 2 parts by weight of a silane coupling agent (γ-methacryloxypropyltrimethoxysilane, manufactured by Shinetsu Kagaku) was further added. This slurry was wet-ground with a ball mill at 1000 rpm for 100 minutes. The surface-treated ytterbium phosphate was recovered as a wet cake (solid content 72%) by centrifugation (3500 rpm, 30 minutes).

17 parts by weight of this wet cake (solid content 72%) was added to and mixed with an offset vehicle comprising 2 parts by weight of acrylate monomer, 4 parts by weight of acrylate oligomer, 3 parts by weight of a wax and 0.5 part by weight of a sentisizer, which was flashed in a vacuum blender to remove a solvent component, to prepare an infrared absorbing offset ink.

One end of the above thermal transfer sheet having the width of 220 mm was adhered to a supply bobbin, which is made of a paper (paper tube) and had the internal diameter of 25 mm, the external diameter of 32 mm and the length of 220 mm, and the thermal transfer sheet was rolled up on the supply bobbin. Next, a bobbin for rolling up was adhered to an end of the final rolling of the rolled up thermal transfer sheet with an adhesive tape having the width of 24 mm. The bobbin for rolling up to be used was similar to that for supply.

The approval card and the thermal transfer sheet were contained in a case as shown in FIG. 5, to obtain a thermal transfer sheet with an approval card of Example B-1.

An invisible mark showing the number of usable image planes printed on the approval card coincided with the number of usable image planes of the above thermal transfer sheet which was actually measured, and the above thermal transfer sheet was truly regular as being approved by a printer manufacturer.

Example B-2

A heat meltable ink layer of tint black having the dried thickness of 4.0 μm was formed on one side of a polyethylene terephthalate film having the thickness of 6 μm as a substrate film with a gravure coater, and a rear layer was formed on the other side of the substrate film in advance, to prepare a thermal transfer sheet.

Then, a component in which an IC chip, an input-output terminal and the like are connected with a conductive material was mounted on a polyethylene terephthalate film having the thickness of 125 μm as a card substrate, to prepare an IC card. A code showing the regularity as being approved by a printer manufacturer was recorded on an integrated circuit. In addition, the number of usable image planes was electrically recorded in advance on an integrated circuit, the number of usable image planes was able to be successively decreased every use.

Then, one end of the above thermal transfer sheet having the width of 220 mm was adhered to a supply bobbin, which is made of a paper (paper tube) and had the internal diameter of 25 mm, the external diameter of 32 mm and the length of 220 mm with an adhesive tape having the width of 24 mm, and the thermal transfer sheet was rolled up on the supply bobbin. Next, a bobbin for rolling up was adhered to an end of the final rolling of the rolled up thermal transfer sheet with an adhesive tape having the width of 24 mm. The bobbin for rolling up to be used was similar to that for supply.

The IC card and the thermal transfer sheet were contained in a case as shown in FIG. 5, to prepare a thermal transfer sheet with an IC card of Example B-2.

The number of usable image planes originally recorded on the IC card coincided with the number of usable image planes of the above thermal transfer sheet which was actually measured, and the above thermal transfer sheet was truly regular as being approved by a printer manufacturer.

Comparative Example B-1

A heat meltable ink layer of tint black having the dried thickness of 4.0 μm was formed on one side of a polyethylene terephthalate film having the thickness of 6 μm as a substrate film with a gravure coater, and a rear layer was formed on the other side of the substrate in advance, to prepare a thermal transfer sheet.

Then, one end of the above thermal transfer sheet having the width of 220 mm was adhered to a supply bobbin, which is made of a paper (paper tube) and had the internal diameter of 25 mm, the external diameter of 32 mm and the length of 220 mm with an adhesive tape having the width of 24 mm, and the thermal transfer sheet was rolled up on the supply bobbin. Next, a bobbin for rolling up was adhered to an end of the final rolling of the rolled up thermal transfer sheet with an adhesive tape having the width of 24 mm. The bobbin for rolling up to be used was similar to that for supply.

In the thermal transfer sheet of Comparative Example B-1, a card on which the number of usable image planes and a code showing the regularity as being approved by a printer manufacturer was not prepared.

Each of the thermal transfer sheets of Examples and Comparative Example was set on a thermal transfer printer for exclusive use and an operation for initiation of printing was conducted.

(Results of Evaluation)

Since a card on which the number of usable image planes and a code showing the regularity as being approved by a printer manufacturer is recorded was not applied to the thermal transfer sheet of Comparative Example B-1, it was impossible to determined whether correct or not, the thermal transfer printer remained stopped and printing was not initiated.

To the contrary, in the thermal transfer sheet of Example B-1, since an invisible mark (bar code) was detected with a card reader having an infrared sensor, the thermal transfer printing was initiated. Since the bar code had an inherent information of the number of recordable image planes, the thermal transfer recording could be conducted with an appropriate printing quality until the end of the number of the image planes.

In addition, in the thermal transfer sheet with the IC card of Example B-2, since a code showing the regularity as being approved by a printing manufacturer was recorded on the IC, and the number of usable image planes was electrically recorded in advance on the IC, and further, the number of usable image planes was successively decreased and recorded every use, then they were detected with a card reader and the thermal transfer printing was initiated. And since the IC had the inherent information of the number of recordable image planes, the printing for thermal transfer could be conducted with appropriate printing quality until the end of the number of the image planes.

Next, the third aspect of the present invention will be explained.

Figure 10:
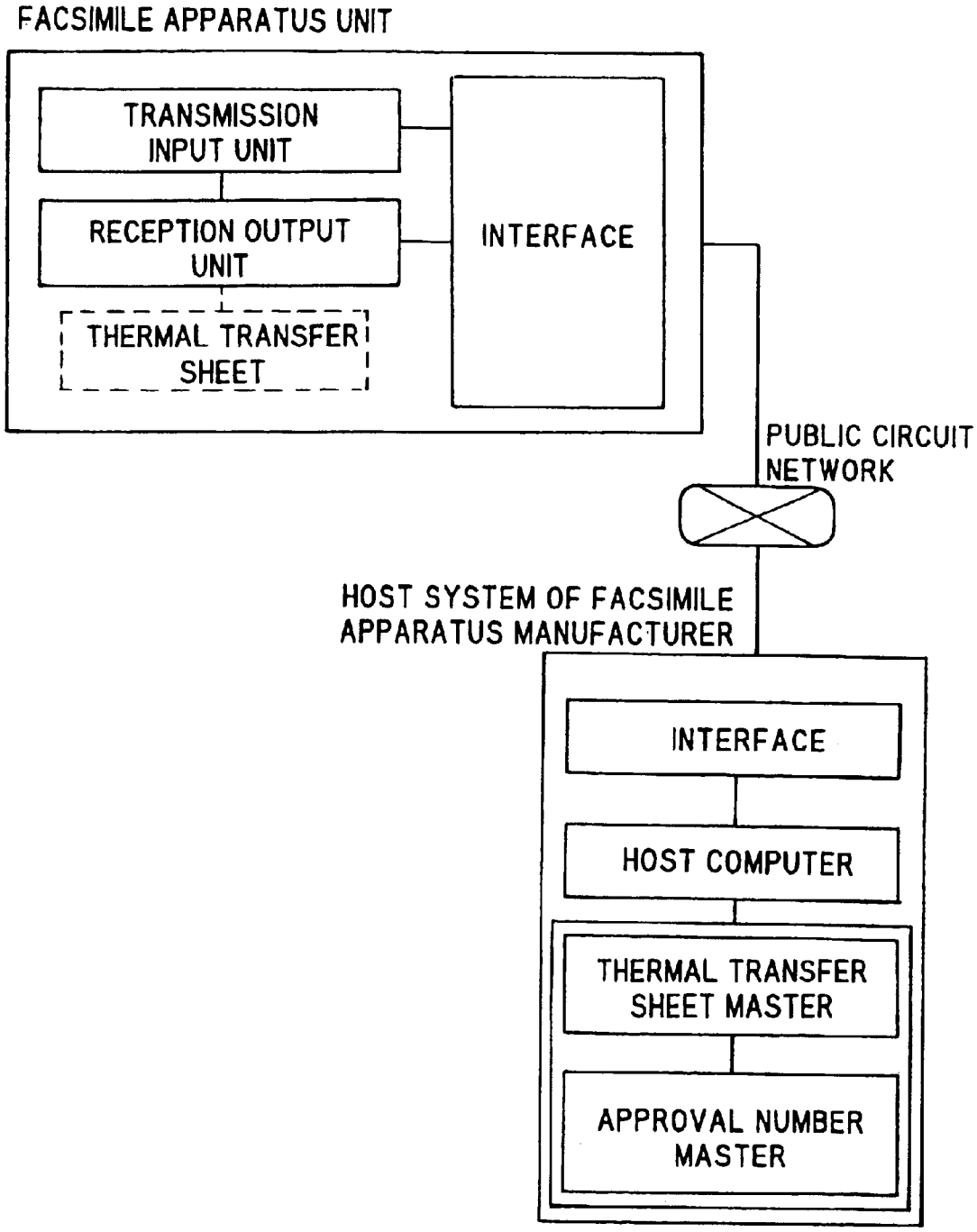
FIG. 10 is a block diagram showing an outlined construction using a thermal transfer sheet of the third aspect in accordance with the present invention in which a facsimile apparatus and a host system of a facsimile apparatus manufacturer are connected via a communication circuit.

FIG. 10 is a block diagram illustrating an outline of the construction in which a facsimile apparatus system using the thermal transfer sheet and a host system of a facsimile apparatus manufacturer or the like are connected via a communication circuit.

The host system of the facsimile apparatus manufacturer or the like is equipped with a host computer connected to an interface and a memory connected to the host computer. The memory has a thermal transfer sheet master which controls an information regarding a thermal transfer sheet to be used in the facsimile apparatus (name of a manufacture who manufactured the thermal transfer sheet, a manufacture lot number of the thermal transfer sheet, a term for effectively using the thermal transfer sheet and the like) and an approval number master which memorized an approval number of the thermal transfer sheet.

It is preferred that the approval number master not only memorizes an approval number but also has the setting which makes an approval number unusable when the same number is used once.

In the thermal transfer recording method and the thermal transfer recording system of the invention of the third aspect, when the reception contents of a facsimile apparatus is received and recorded on a recording paper using a thermal transfer sheet, the facsimile apparatus is connected to a host system of the facsimile apparatus manufacturer or the like via a communication circuit, an approval number applied to a thermal transfer sheet to be used is input, the host system checks whether the approval number is registered or not and, only when the approval number is determined to be correct, the facsimile becomes receivable and recordable.

FIG. 10 shows an example in which a facsimile apparatus system and a host system of a facsimile apparatus manufacturer are connected via a public circuit network. A communication circuit of each system is not limited to the public circuit network but a communication for exclusive use may be utilized.

As a facsimile apparatus system, the general facsimile apparatuses on the market can be utilized. That is, there can be utilized a facsimile apparatus in which a transmission input unit by which users can send images and manuscripts such as letters and the like to any place via a communication circuit and a reception output unit which can record the received contents are controlled and adjusted by an interface so that both units can transmit and receive with a signal of a communication circuit.

However, a facsimile apparatus which can be utilized in the present invention is limited to such the types that a reception output unit receives and records on a recording paper using a thermal transfer sheet and, further, the facsimile apparatus is connected to a host system of a manufacturer or the like of the above facsimile apparatus via a communication circuit.

When a facsimile apparatus is connected to a host system of a facsimile apparatus manufacturer via a communication circuit, the number for connecting to the host system may be input through a public circuit network, or a shortened number in which its facsimile number is registered may be only pushed.

Next, procedures for making a facsimile apparatus receivable and recordable in the state where a thermal transfer sheet is set thereon, by utilizing the above facsimile apparatus system and a host system of a facsimile apparatus manufacturer or the like will be explained.

A manufacturer who manufactures a thermal transfer sheet used in a facsimile apparatus gives an approval number to the thermal transfer sheet by every one manufactured unit (which is one of units used in a facsimile apparatus, generally, one roll unit). Although the approval number may be the same as manufacture lot number, it is preferable that the number is not successive one or easily readable one in order to make it difficult to manufacture pirated articles.

For example, random numbers may be assigned or number obtained by dividing successive numbers by seven or nine to give an odd which may be assigned to the first figure.

A different number is assigned to the approval numbers as described above every one unit of a thermal transfer sheet and, before the thermal transfer sheet is used in a facsimile apparatus, the approval number is registered and memorized in advance in a approval number master of a host system of a facsimile apparatus manufacturer.

Users of a facsimile apparatus first set a thermal transfer sheet at a facsimile apparatus.

Then, before users input an approval number applied to the thermal transfer sheet, they push a shortened number or the like for connecting to a host system of a facsimile apparatus manufacturer to connect to the host system.

When input of the approval number is completed, the approval number is sent to a host system of a facsimile apparatus manufacturer via a communication circuit. Then, the transmitted approval number is confirmed from a host computer of a facsimile apparatus manufacturer, the host computer looks up an approval number master and checks whether the approval number has been registered or not and, if necessary, looks up a thermal transfer sheet master, investigate the name of a manufacturer who made the thermal transfer sheet, the manufacture lot number of the thermal transfer sheet, the term for effectively using the thermal transfer sheet and the like to determine whether the thermal transfer sheet is OK for use or not and, only when all are determined to correct, a facsimile apparatus becomes receivable and recordable.

Then, preferably, after the above determination of OK, a host computer of a facsimile apparatus manufacturer records on an approval number master that the approval number was used and, if necessary, records on a thermal transfer sheet master that the thermal transfer sheet having a manufacture lot number corresponding to the approval number was used.

Thereby, when the same approval number is used next time, it is determined that the corresponding thermal transfer sheet can not be used. Therefore, when try to use a thermal transfer sheet which did not receive approval of the quality assurance by a facsimile apparatus manufacturer, the approval number which was used earlier can be prevented from stealing.

On the other hand, the sent approval number is confirmed from a host computer of a facsimile apparatus manufacturer, the host computer looks up an approval number master and checks whether the approval number has been registered or not and, if necessary, looks up a thermal transfer sheet master and, when not determined to be correct, a host computer of a facsimile apparatus manufacturer transmits that effect to the corresponding facsimile apparatus to display an error massage on a monitor or display a question which asks whether initiation of reception and recording should be stopped or not. Anyhow, reception and recording of a facsimile apparatus remains stopped.

Now, as how to display an approval number applied every one unit of the above thermal transfer sheet, any method can be adopted such as by applying a label having an approval number recorded thereon to an end of the rolled up thermal transfer sheet, or directly recording an approval number on an edge face of a core in the state where a thermal transfer sheet is rolled up on the core, or recording a number on a label and applying the label to an edge face of the core, or directly recording an approval number on a front part of a thermal transfer sheet, or directly recording an approval number on a thermal transfer sheet in a repeated manner at any interval along a flow direction of the thermal transfer sheet.

In addition, in order to prevent forgery and appropriation of an approval number, the approval number is preferably not a visible information but an invisible information.

When the above approval number is formed as an invisible information, examples thereof are the numbers which have the particular optical properties in an ultraviolet ray region or an infrared ray region and absorb the light of those wavelengths or emits the fluorescent light in response to the irradiated light. The invisible information can be read by means of a proper machine and then directly transmitted to the host system via the communication circuit.

More particularly, the invisible marks formed in the invention of the first aspect or the second aspect as described above may be also applied to the thermal transfer sheet for a facsimile of the third aspect as they are.

In addition, the thermal transfer sheet, the thermal transfer recording method and the thermal transfer recording system of the invention of the third aspect are not limited to the above embodiments and may be composed of various facsimile apparatus systems and host systems of facsimile apparatus manufactures or the like, within the scope of the invention.

What is claimed is:

1. A thermal transfer sheet which comprises an approval information of being approved as applicable to the predetermined printer;

wherein a mark coded from the approval information is provided on a front part of the thermal transfer sheet;

wherein the mark is an invisible mark not detectable with the visible light, and the invisible mark is detectable by changing electromagnetic properties in response to a microwave.

2. A thermal transfer sheet which comprises an approval information of being approved as applicable to the predetermined printer;

wherein a mark coded from the approval information is provided on a front part of the thermal transfer sheet;

wherein the mark is a circuit which makes a resonance with the received high frequency wave to transmit an echo wave corresponding to the approval information.

3. A thermal transfer sheet which comprises an approval information of being approved as applicable to the predetermined printer;

wherein an approval card is combined with the thermal transfer sheet at one versus one, and the number of usable image planes and an invisible mark coded from the approval information are recorded on the approval card.

4. The thermal transfer sheet according to claim 3, wherein the invisible mark is detectable by changing electromagnetic properties in response to a microwave.

5. A thermal transfer sheet which comprises an approval information of being approved as applicable to the predetermined printer;

wherein a resonance circuit is combined with the thermal transfer sheet at one versus one and, the resonance circuit makes a resonance with the received high frequency wave to transmit an echo wave corresponding to the number of usable image planes and the approval information.

6. A thermal transfer sheet which comprises an approval information of being approved as applicable to the predetermined printer;

wherein an IC card having an integrated circuit is combined with the thermal transfer sheet at one versus one and, on the integrated circuit, the number of usable image planes is electrically recorded in advance and at the same time a code showing the approval information is recorded.

7. The thermal transfer sheet according to claim 6, wherein the integrated circuit of the IC card can record the remaining number of usable image planes obtained by subtracting the actually used number of image planes from the original number of usable image numbers every thermal transfer.

8. A thermal transfer sheet which comprises an approval information of being approved as applicable to the predetermined printer;

wherein the approval information is an approval code which is registered in a host system capable of being accessed via a communication circuit.

9. The thermal transfer sheet according to claim 8, wherein the approval code is an approval number.

* * * * *